US009358474B2

(12) United States Patent
Rehkemper et al.

(10) Patent No.: US 9,358,474 B2
(45) Date of Patent: Jun. 7, 2016

(54) FLYING TOY DOLL ASSEMBLY

(71) Applicant: Rehco, LLC, Chicago, IL (US)

(72) Inventors: Jeffrey Rehkemper, Chicago, IL (US); Steven Rehkemper, Chicago, IL (US); John Peach, Chicago, IL (US); Ana Sessler, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 95 days.

(21) Appl. No.: 14/294,032

(22) Filed: Jun. 2, 2014

(65) Prior Publication Data

US 2014/0378021 A1 Dec. 25, 2014

Related U.S. Application Data

(63) Continuation-in-part of application No. 29/458,743, filed on Jun. 21, 2013, now Pat. No. Des. 740,376.

(51) Int. Cl.

| | |
|---|---|
| ***A63H 27/127*** | (2006.01) |
| ***A63H 27/00*** | (2006.01) |
| ***A63H 3/48*** | (2006.01) |
| ***A63H 3/52*** | (2006.01) |
| *A63H 3/50* | (2006.01) |

(52) U.S. Cl.

CPC ..... *A63H 27/12* (2013.01); *A63H 3/48* (2013.01); *A63H 3/52* (2013.01); *A63H 3/50* (2013.01)

(58) Field of Classification Search

USPC ..... 473/36.37, 41; 446/36.37, 41, 4, 36, 37, 446/42, 57, 71, 72, 234, 268, 236, 255, 256

See application file for complete search history.

(56) References Cited

U.S. PATENT DOCUMENTS

| | | | | | |
|---|---|---|---|---|---|
| D183,794 | S | * | 10/1958 | Gardner | A63H 27/00 D21/441 |
| 5,071,383 | A | * | 12/1991 | Kinoshita | A63H 27/10 244/26 |
| 5,525,086 | A | * | 6/1996 | Gentile | A63H 27/14 446/234 |
| D372,277 | S | * | 7/1996 | Henley | A63H 27/00 D21/436 |
| 5,672,086 | A | * | 9/1997 | Dixon | A63H 27/00 446/37 |
| 2006/0121819 | A1 | * | 6/2006 | Isawa | A63H 27/12 446/37 |
| 2012/0025012 | A1 | * | 2/2012 | Arlton | B64C 27/10 244/17.13 |
| 2014/0227932 | A1 | * | 8/2014 | Sullivan | A63H 27/12 446/37 |

* cited by examiner

*Primary Examiner* — Nini Legesse

(74) *Attorney, Agent, or Firm* — Brooks Kushman P.C.

(57) ABSTRACT

A flying toy figure is provided which may include a doll body extending in a longitudinal direction and may have a longitudinal axis which is substantially vertical. A first propeller assembly may be mounted to rotate in a first direction about the longitudinal axis of the doll body and may be positioned longitudinally along a mid-portion of the doll body. A second propeller assembly mechanically linked to the first propeller assembly may be mounted to rotate in a second direction about the longitudinal axis of the doll body and is positioned below the first propeller assembly. A rechargeable power source may be in communication with a motor to drive the first and second propeller assemblies. One or more sensors may be included with the figure to detect a surface external to the doll body and may be configured to provide a surface detection signal. A controller may be in communication with the motor and one or more sensors to adjust a speed of the motor in response to receiving the surface detection signal from the switch. Adjusting the motor speed adjusts a counter-rotational speed of the first and second propeller assemblies.

38 Claims, 23 Drawing Sheets

FLYING TOY DOLL ASSEMBLY

CROSS-REFERENCE TO RELATED APPLICATIONS

This application is a continuation-in-part of U.S. application Ser. No. 29/458,743 filed Jun. 21, 2013, the disclosure of which is hereby incorporated in its entirety by reference herein.

TECHNICAL FIELD

This disclosure relates to propeller assemblies and control systems for flying toys.

BACKGROUND

Flying toy entities may utilize various types of components to create propeller assemblies and toy entity structures to assist in generating lift for the toy entity. Various types of control systems may also be used to direct operation of the components. Improvements in electronics and mechanics continue to reduce the weight of the components and also provide additional packaging space to create new flying toy entities which improve play patterns and enjoyment for a user. Traditional flying toys have used multiple forms of manual or spring launched gliders providing horizontal flight as well as manual or spring launched propeller toys for vertical flight. Toy helicopters in particular have benefited from the improvements in electronics and mechanics. A desire remains for non-helicopter style lightweight electric motorized vertical interactive flying toys.

SUMMARY

A flying toy doll includes a doll body extending in a longitudinal direction and having a longitudinal axis being substantially vertical. The doll has a mid-body section defined longitudinally between an upper body section and a lower body section, a head secured to the upper body section, and a pair of arms secured to the upper body section and each extending outwardly therefrom. The doll also has an upper propeller assembly and a lower propeller assembly. The upper propeller assembly is mounted to the doll body and has at least two upper blades hinged at a proximal end of the upper blade for pivotal movement such that a distal blade end moves between at least a resting position and a flying position. In the flying position, the upper blades are generally perpendicular to the longitudinal axis of the doll body and each of the upper blades has a leading edge and a trailing edge extending between the distal end and proximal end of the upper blades, and a safety arc portion. A lower propeller assembly is mounted to the doll body and offset at a longitudinal distance below the upper propeller assembly and has two or more lower blades hinged at a proximal end of each of the lower blades for pivotal movement such that a distal blade end of each of the blades moves between at least a resting position and a flying position. In the flying position, the lower blades are generally perpendicular to the longitudinal axis of the doll body. Each of the lower blades has a leading edge and a trailing edge extending between the distal end and proximal end of the lower blades, and a safety arc portion. The upper leading edges of the upper blades are oriented opposite the lower leading edges of the lower blades. The two upper blades and the two or more lower blades form an appearance of a skirt and conceal at least a portion of the lower body portion of the doll when in the resting positions.

A flying toy figure includes a doll body extending in a longitudinal direction and has a longitudinal axis which is substantially vertical. A first propeller assembly is mounted to rotate in a first direction about the longitudinal axis of the doll body and positioned longitudinally along a mid-portion of the doll body. A second propeller assembly is mounted to rotate in a second direction about the longitudinal axis of the doll body and is positioned below the first propeller assembly. The second propeller assembly is mechanically linked to the first propeller assembly for counter rotation in the second direction when the first assembly rotates in the first direction. A motor is in communication with the first and second propeller assemblies to drive the first and second propeller assemblies in the first and second direction at a speed. A rechargeable power source is in communication with the motor. A switch is secured to at a foot portion of the body to detect a surface external to the doll body and is configured to provide a surface detection signal. A controller is in communication with the motor and switch and configured to adjust a speed of the motor in response to receiving the surface detection signal from the switch. Adjusting the motor speed adjusts a counter-rotational speed of the first and second propeller assemblies.

A flying toy doll includes an upper section, a pair of arms fixed to the upper section, a head fixed to the upper section, a central shaft extending from the upper section and defining a central axis extending in an upright direction, a lower section fixed to the central shaft, a mid-section disposed between the lower section and the upper section and mounted to the central shaft for rotation about the central axis, and a leg member fixed to the lower section. The flying toy figure also includes a first propeller mount mounted to the central shaft for rotation in a first direction about the central axis and pivotal movement about a first propeller mount axis defined by two upper receiving brackets extending outward. The flying toy figure also includes a first set of blades. Each blade of the first set of blades is connected to the first propeller mount to pivot at a first proximal end mounted to one of the upper receiving brackets for hinged movement at the first proximal end between at least a lowered and raised position, and includes a safety arc extending from the proximal end to the distal end. A second propeller mount is mounted to the central shaft below the mid-section for rotation in a second direction and defines at least two lower receiving brackets extending outward. A second set of blades, each defining a second proximal end, are mounted to one of the lower receiving brackets for hinged movement at the second proximal end between at least a lowered and raised position. A gear train mechanically links the first and second propeller mounts for counter rotation such that the second propeller mount rotates in the second direction when the first propeller mount rotates in the first direction. The flying toy doll also includes a motor in communication with the gear train, a rechargeable power source in communication with the motor, a lower transmitter secured to the leg member to transmit a lower detection signal, a lower receiver secured to the lower section to receive a reflected lower detection signal indicative of a surface being external to the toy doll at a distance, and a controller in communication with the motor, the lower transmitter, and the lower receiver. The controller is configured to adjust a speed of the motor in response to the lower receiver receiving the reflected lower detection signal. Adjusting the motor speed adjusts a counter-rotational speed of the first and second propeller mounts.

A flying toy figure includes an upper section, a pair of arms extending upward from the upper section, a head fixed to the upper section, a central shaft extending from the upper section and defining a central axis extending in an upright direction, a lower section fixed to the central shaft, a mid-section disposed between the lower section and the upper section and mounted to the central shaft for rotation, and a leg member fixed to the lower section. A first propeller mount is mounted to the central shaft for rotation in a first direction and pivotal movement, and defines two upper receiving brackets. Each blade of a first set of blades is connected to the upper receiving brackets to pivot between at least two positions. A second propeller mount is mounted to the body mid-section for rotation in a second direction and defines four lower receiving brackets extending outward. Each blade of a second set of blades is connected to one of the lower receiving brackets to pivot between at least two positions. The flying toy figure also includes a flybar mount mounted to the central shaft for rotation in the first direction and pivotal movement, a flybar mounted to the flybar mount, a gear train mechanically linking the first and second propeller mounts for counter rotation, a motor secured to the lower section and in communication with the gear train, and a rechargeable power source in communication with the motor. A controller is configured to direct operation of the motor and rechargeable power source. An upper transmitter is secured to the head, oriented to send an upper detection signal in an upward direction relative to the head, and in communication with the controller. An upper receiver is secured to the head, oriented to receive the upper detection signal when reflected off of a surface, and in communication with the controller. The controller is configured to adjust a speed of the motor in response to the upper receiver receiving the reflected upper detection signal indicating detection of a surface.

DETAILED DESCRIPTION

Figure 1:
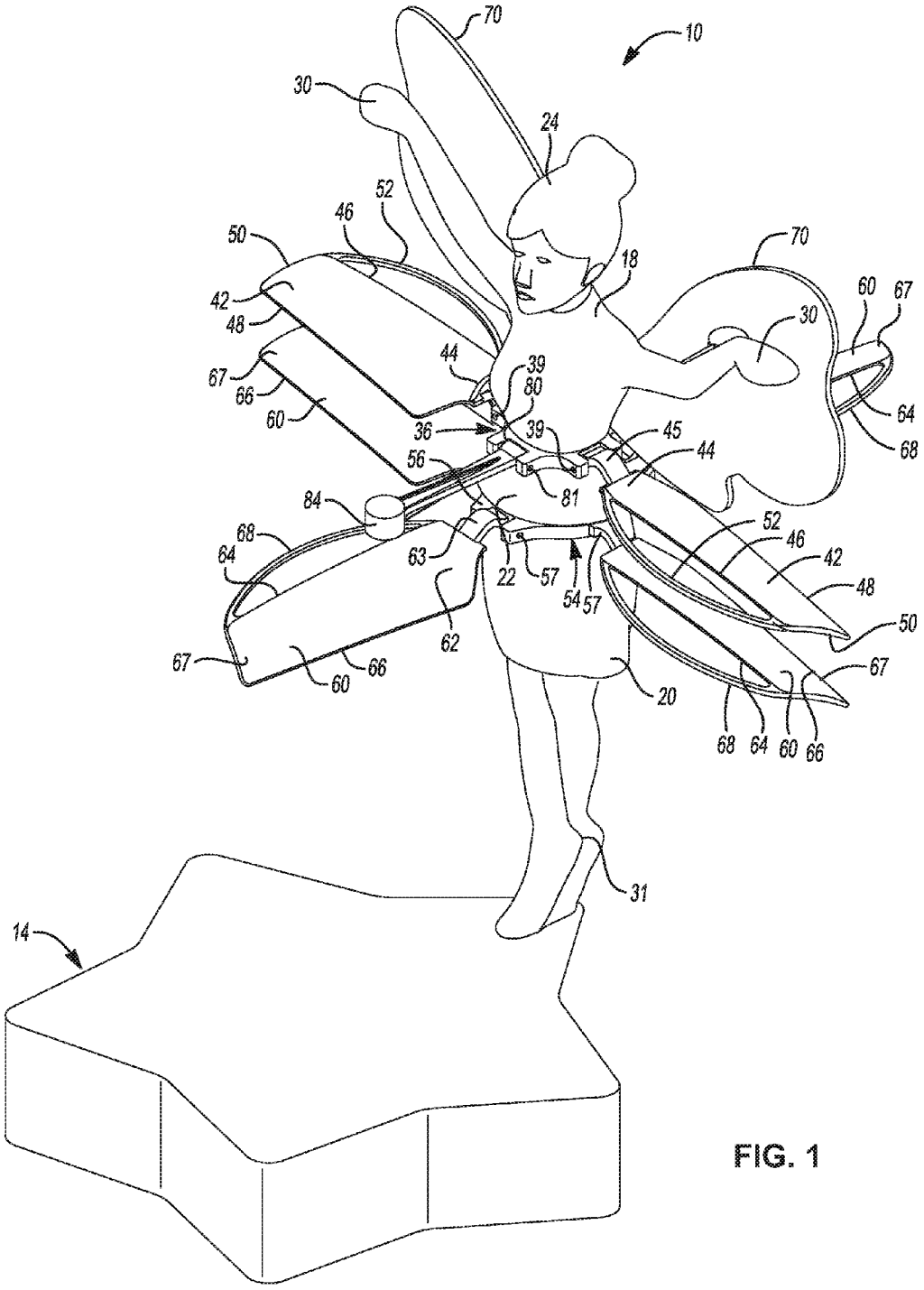
FIG. 1 is a perspective view of an example of a flying toy doll shown in a first configuration and supported by a charge base.
Figure 2:
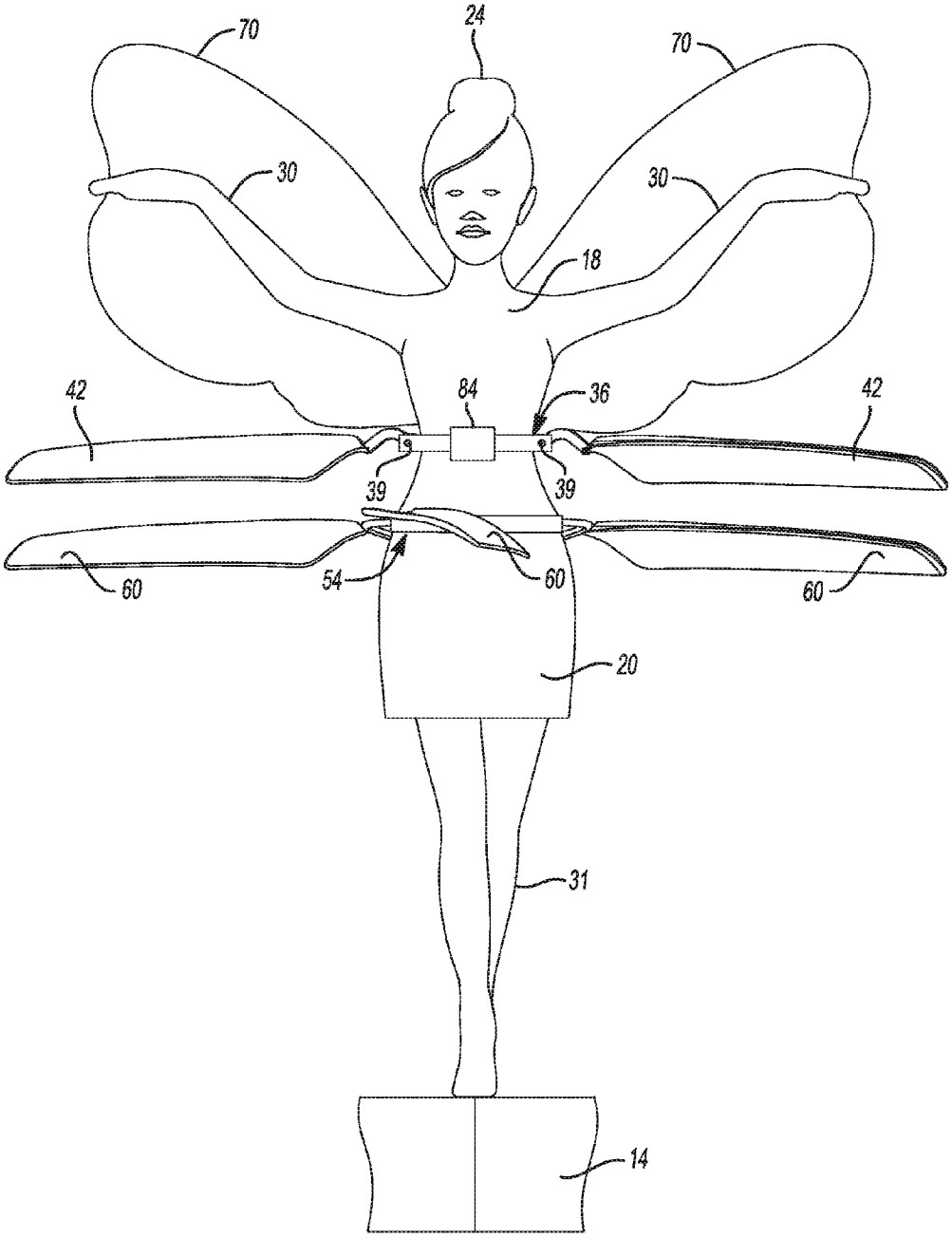
FIG. 2 is a front view of the flying toy doll of FIG. 1 and a fragmented view of the charge base of FIG. 1.
Figure 3:
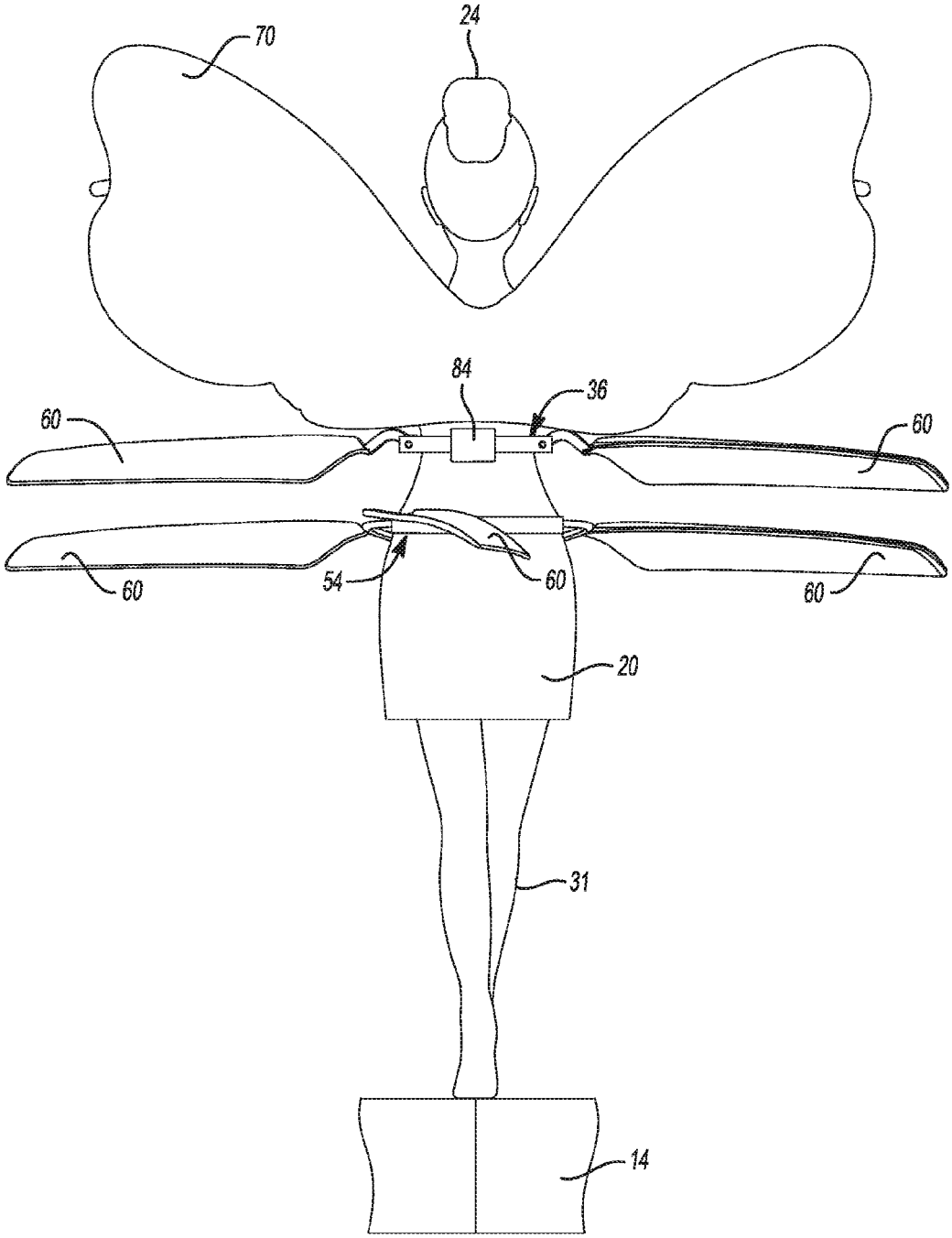
FIG. 3 is a rear view of the flying toy doll of FIG. 1 and a fragmented view of the charge base of FIG. 1.
Figure 4:
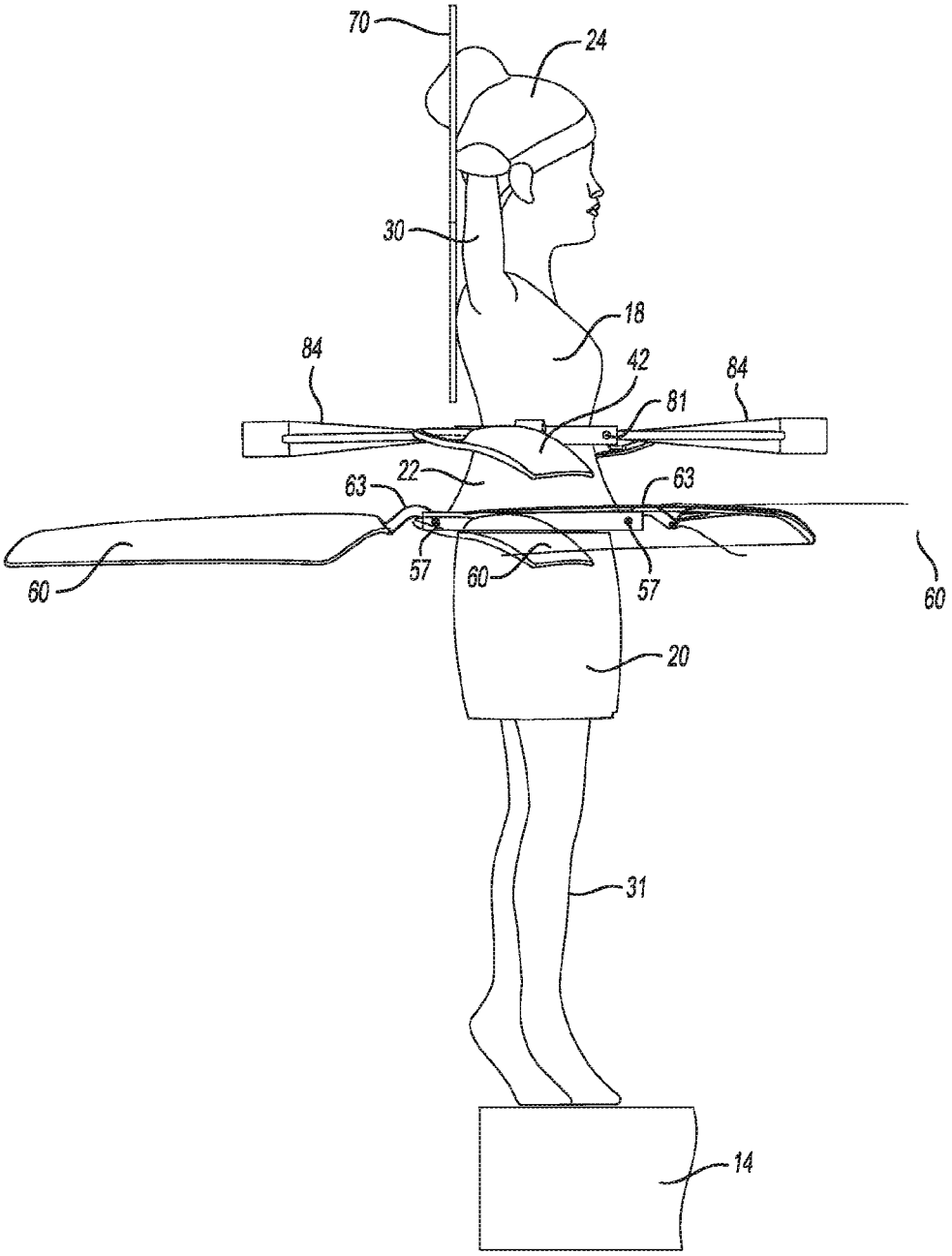
FIG. 4 is a right side view of the flying toy doll of FIG. 1 and a fragmented view of the charge base of FIG. 1.
Figure 5:
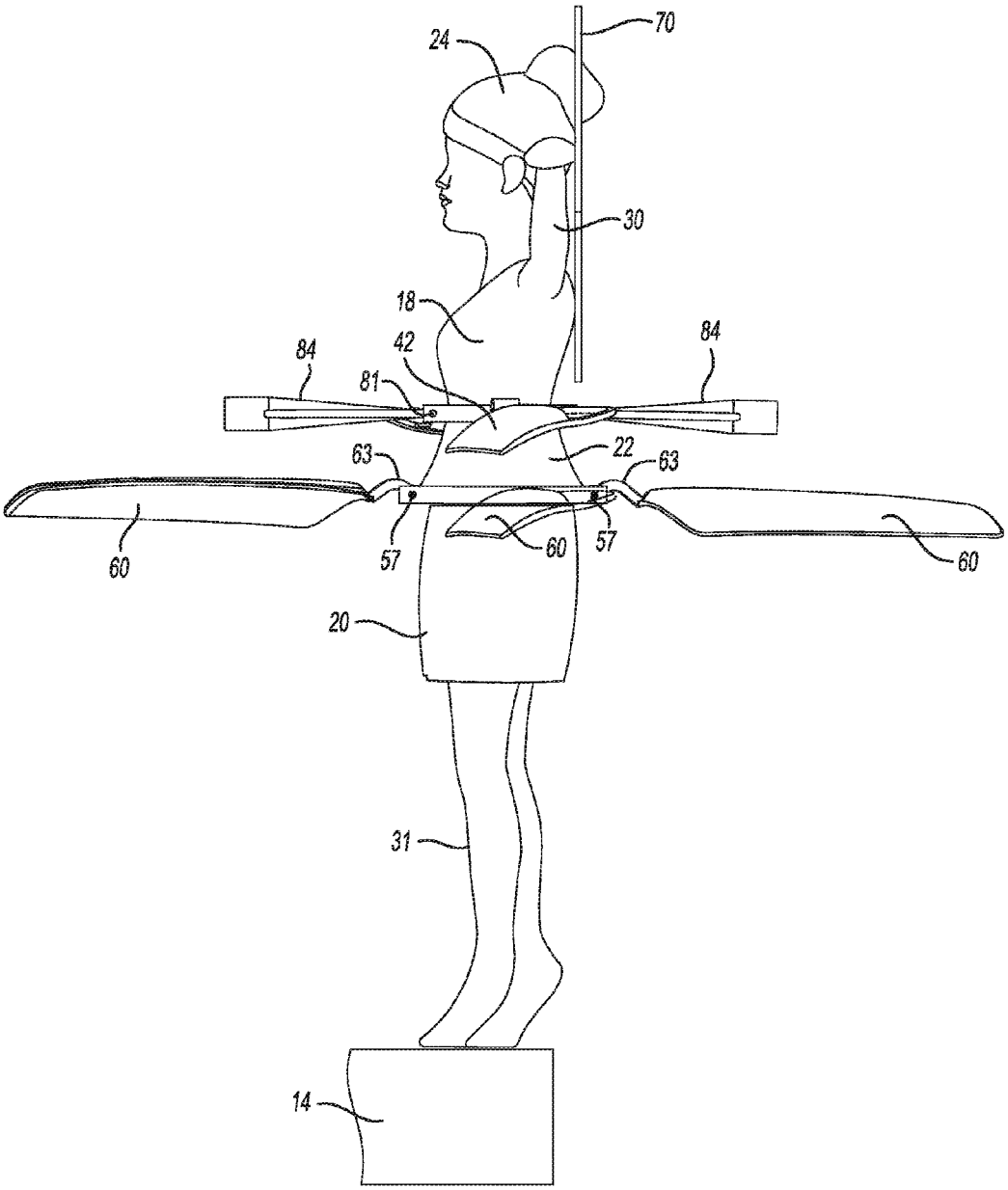
FIG. 5 is a left side view of the flying toy doll of FIG. 1 and a fragmented view of the charge base of FIG. 1.
Figure 6:
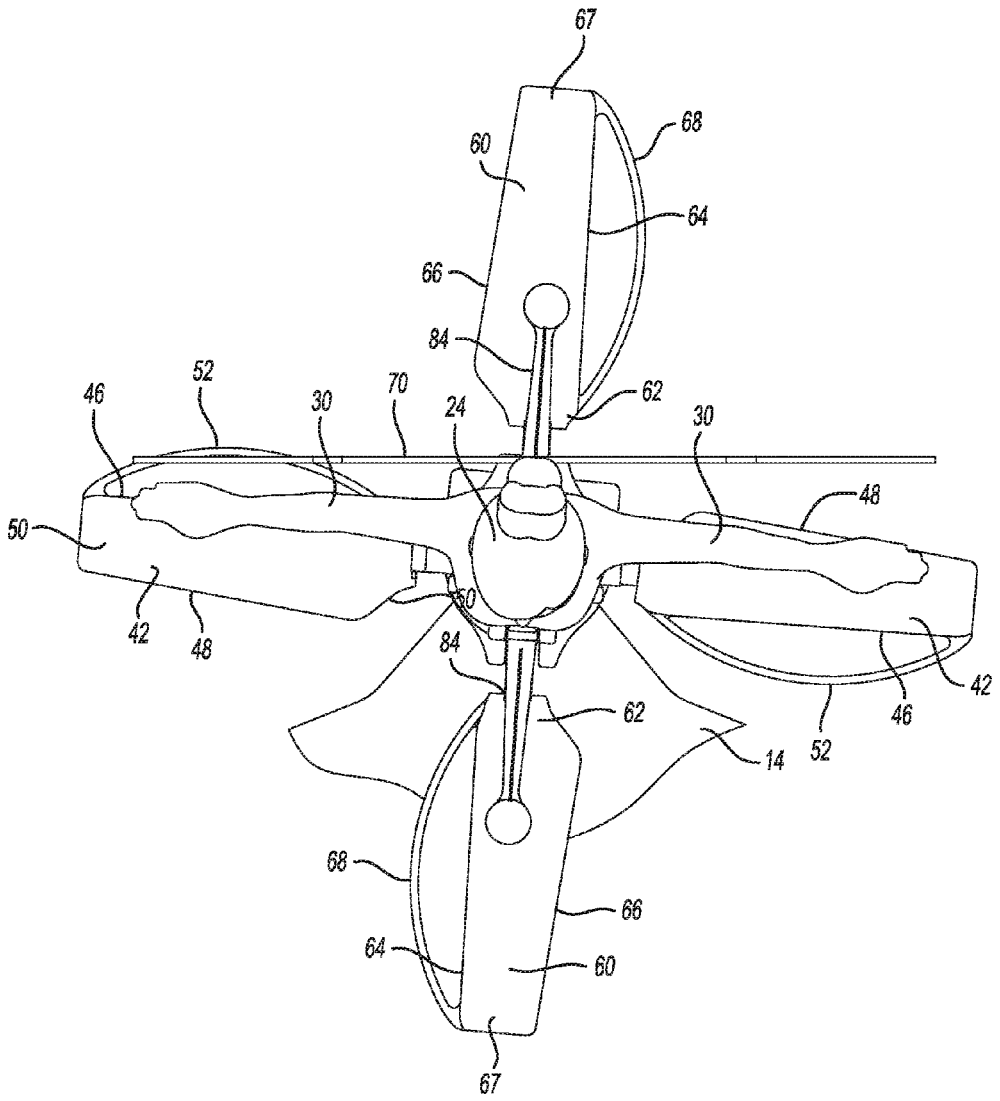
FIG. 6 is a plan view of the flying toy doll of FIG. 1.
Figure 7:
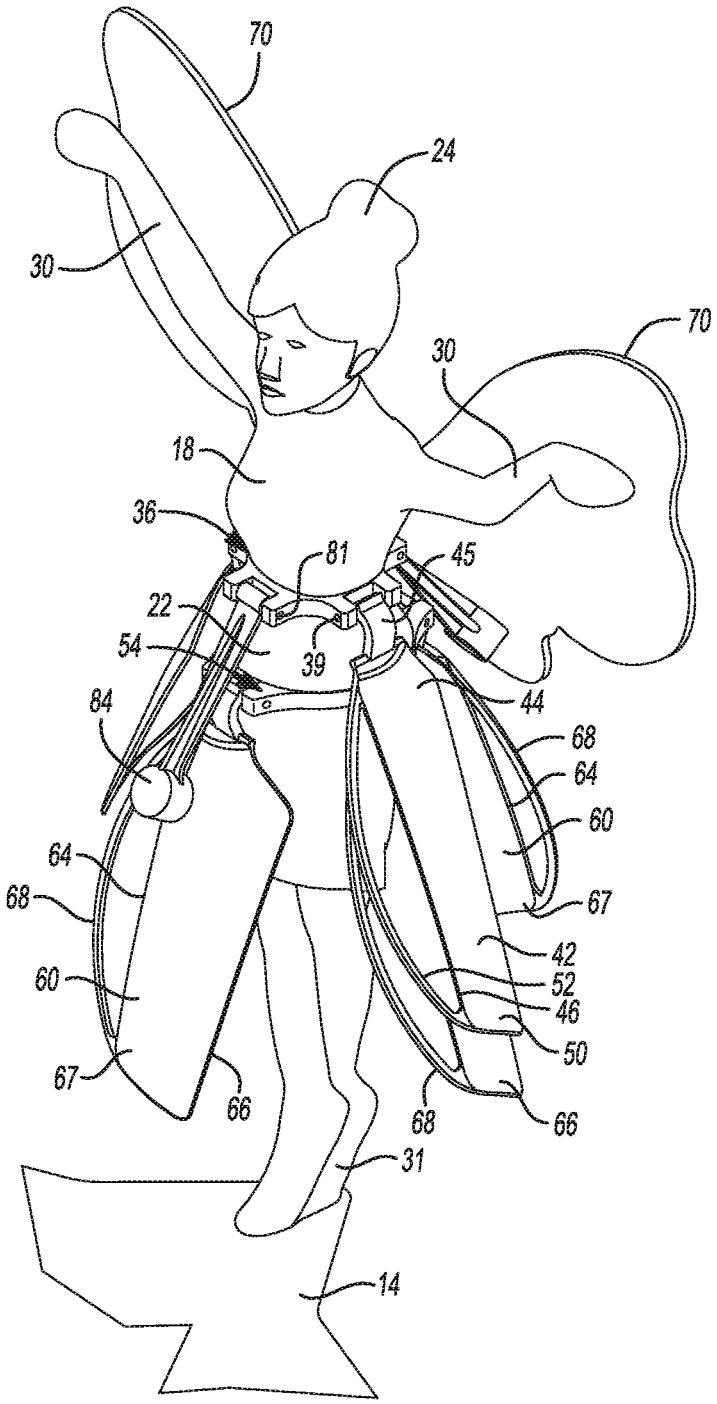
FIG. 7 is a perspective view of the flying toy doll from FIG. 1 shown in a second configuration and a fragmented view of the charge base of FIG. 1.
Figure 8:
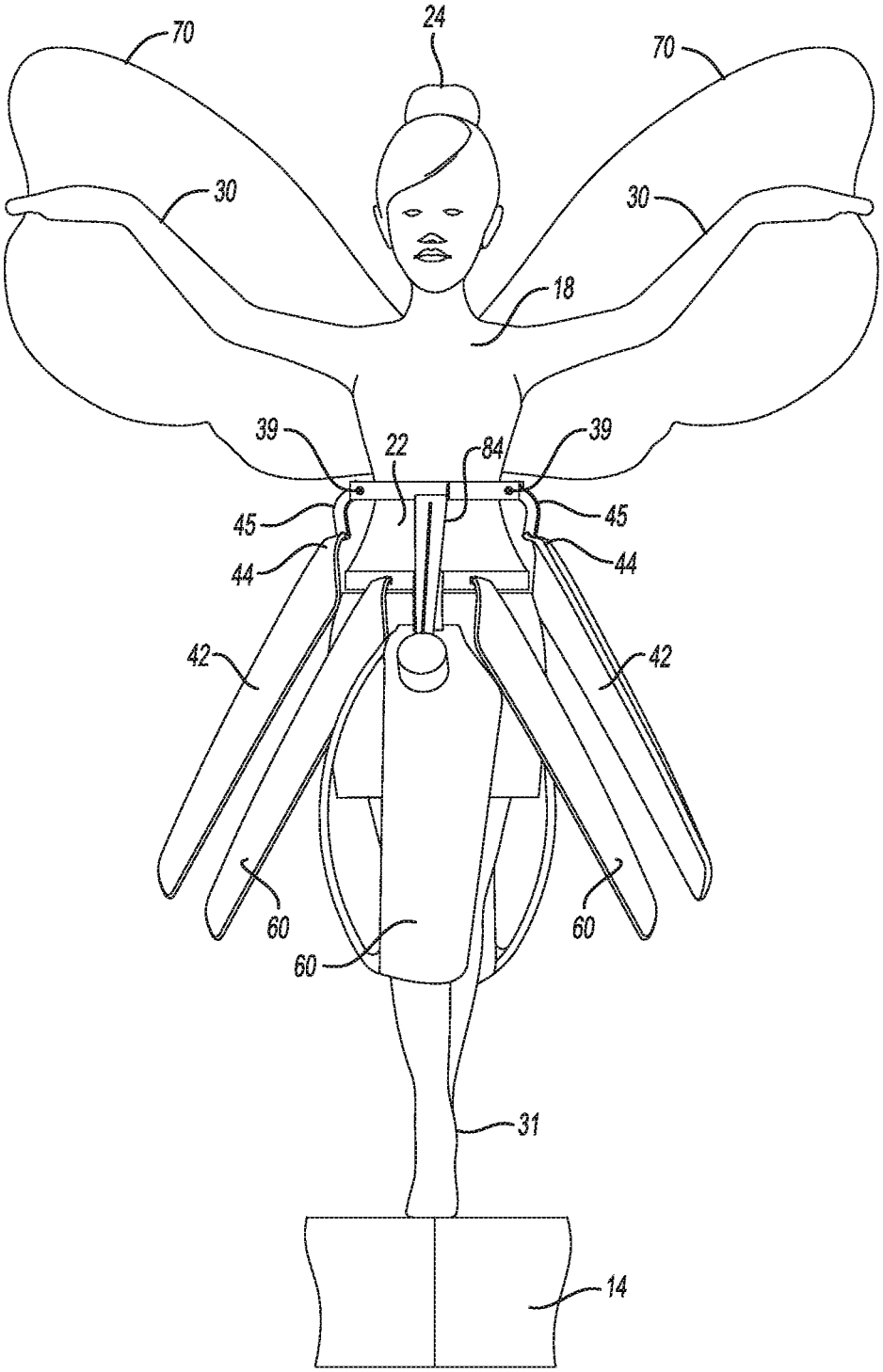
FIG. 8 is a front view of the flying toy doll of FIG. 1 shown in the second configuration and a fragmented view of the charge base of FIG. 1.
Figure 9:
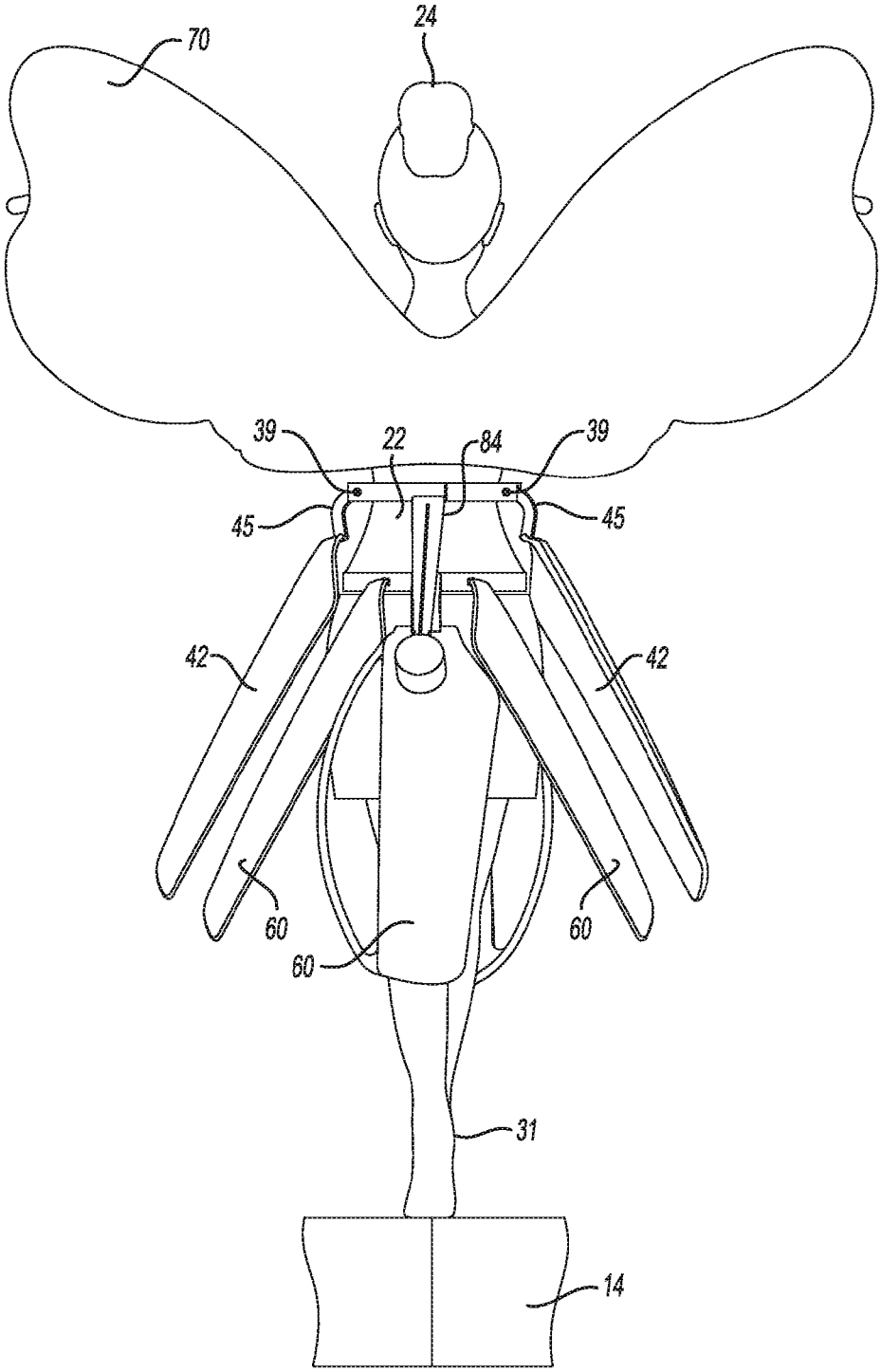
FIG. 9 is a rear view of the flying toy doll from FIG. 1 shown in a second configuration and a fragmented view of the charge base of FIG. 1.
Figure 10:
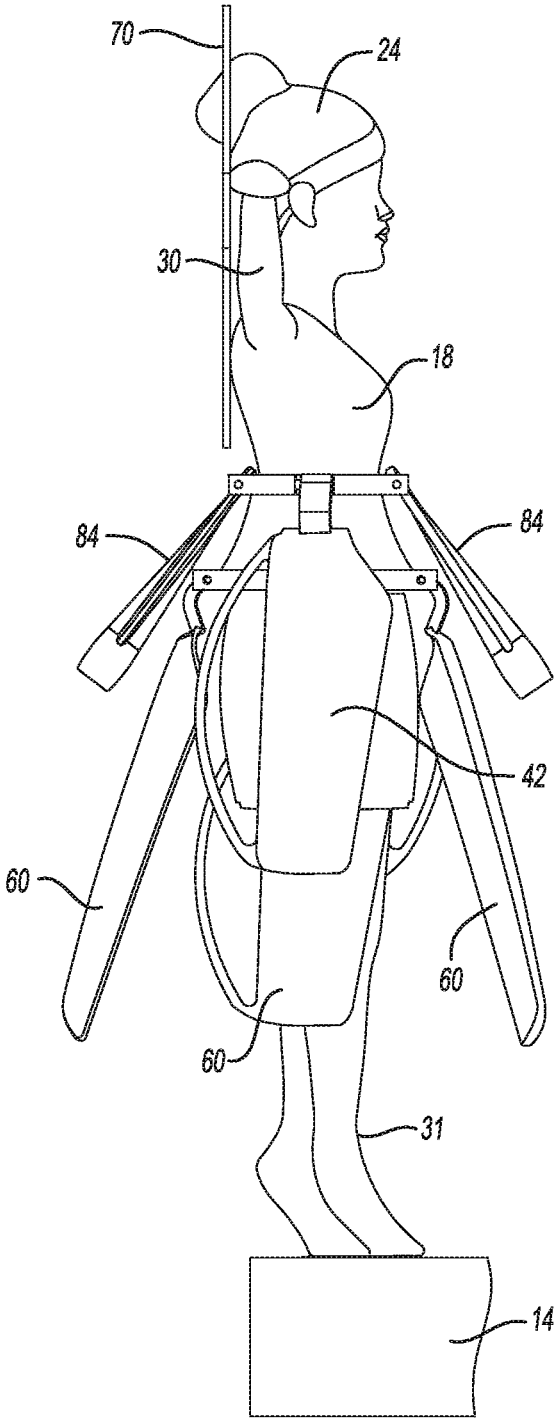
FIG. 10 is a right side view of the flying toy doll of FIG. 1 shown in the second configuration and a fragmented view of the charge base of FIG. 1.
Figure 11:
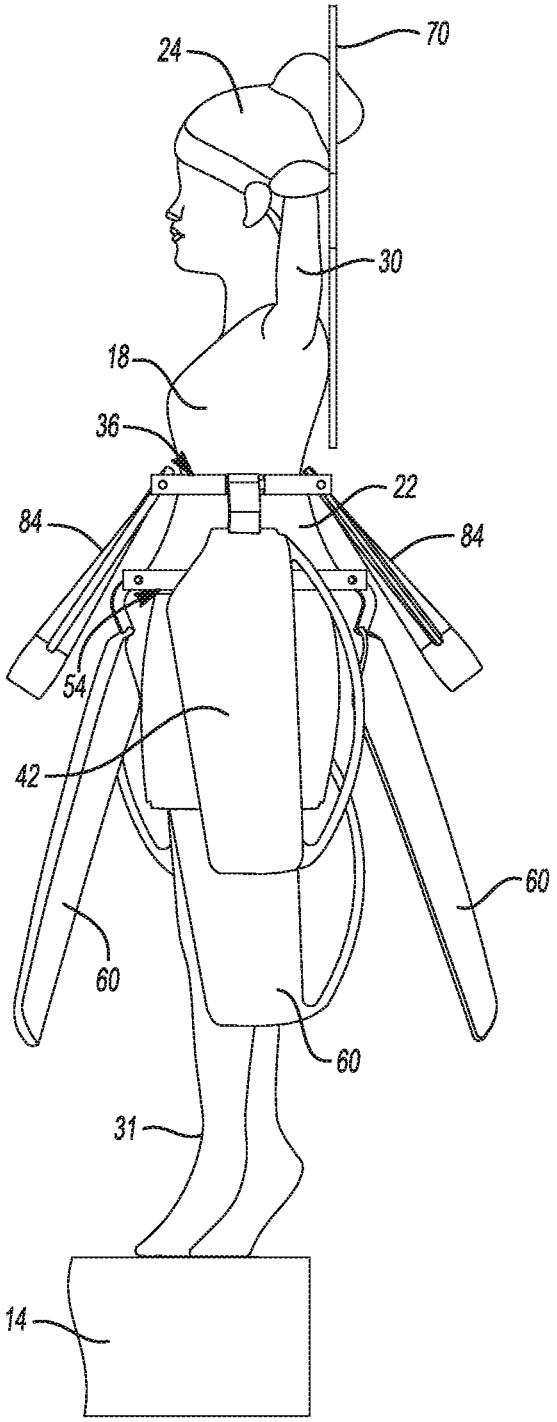
FIG. 11 is a left side view of the flying toy doll of FIG. 1 shown in the second configuration and a fragmented view of the charge base of FIG. 1.
Figure 12:
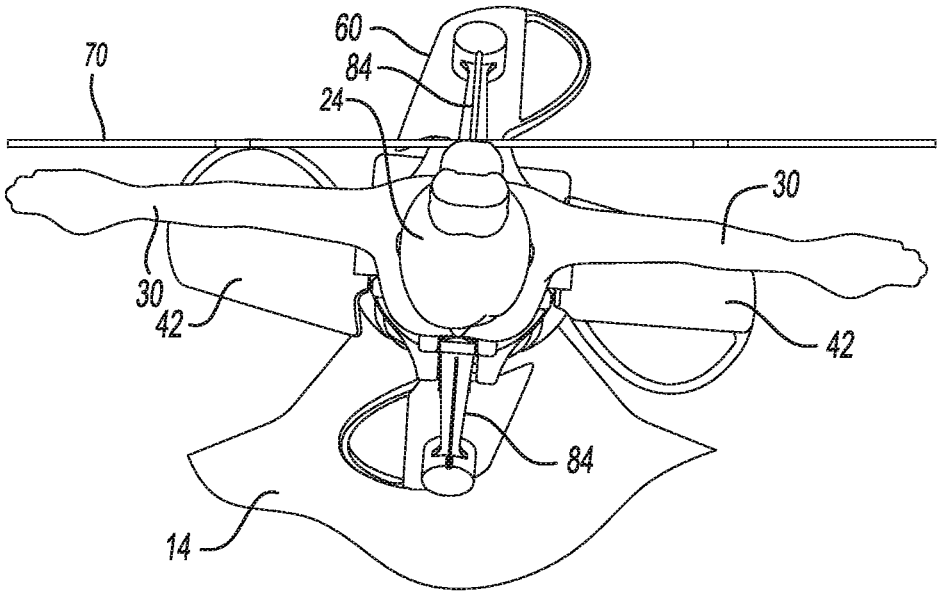
FIG. 12 is a plan view of the flying toy doll of FIG. 1 shown in the second configuration and a fragmented view of the charge base of FIG. 1.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

In one example, FIGS. 1 through 12 show a flying toy doll 10 supported by a charge base 14. The flying toy doll 10 may be removable from the charge base 14. The flying toy doll 10 may include a body extending in a longitudinal direction and having a longitudinal axis being substantially vertical. The flying toy doll 10 has an upper body section 18 and a lower body section 20. A mid-body section 22 may be mounted to the body between the upper body section 18 and the lower body section 20. A head 24 may be secured to the upper body section 18. A pair of arms 30 may be secured to the upper body section 18 and extend outwardly therefrom. A leg member 31 may extend from the lower body section 20. An upper propeller mount 36 may be mounted to the mid-body section for rotation. The upper propeller mount 36 may define two upper blade receiving brackets 38 extending outward from the upper propeller mount 36. For example, the upper blade receiving brackets 38 may each define a pair of upper bracket prongs adapted to receive an upper pin 39 extending therebetween. Two upper blades 42 may each define a proximal end 44 and an upper extension 45 mounted to one of the upper blade receiving bracket 38 at the upper pin 39 for hinged movement between at least two positions. For example, FIGS. 1 through 6 show the upper blades 42 in a raised position or flying position and FIGS. 7 through 12 show the upper blades 42 in a lowered position or resting position. The two upper blades 42 may each define a leading edge 46 and a trailing edge 48 relative to a first direction of rotation. A leading edge of blade corresponds to a direction of rotation of a respective propeller mount. The two upper blades 42 may each define a distal end 50 and a safety arc 52 which may extend between the proximal end 44 and the distal end 50. The distal end 50 moves between at least the lowered position and the raised position. In the flying position, the upper blades 42 are generally perpendicular to the longitudinal axis of the body of the flying toy doll 10.

A lower propeller mount 54 may be mounted to the body of the flying toy doll 10 for rotation. The lower propeller mount 54 may define two or more lower receiving brackets 56 extending outward from the lower propeller mount 54. For example, the lower blade receiving brackets 56 may each define a pair of lower bracket prongs adapted to receive a lower pin 57 extending therebetween. Two or more lower blades 60 may each define a proximal end 62 and a lower extension 63 mounted to one of the lower receiving brackets 56 at the lower pin 57 for hinged movement between at least two positions.

For example, FIGS. 1 through 6 show the lower blades 60 in a raised position or flying position and FIGS. 7 through 12 show the lower blades 60 in a lowered position or resting position. When the upper blades 42 and the lower blades 60 are both in the respective lowered positions, the blades may form an appearance of a skirt. The two or more lower blades 60 may each define a leading edge 64 and a trailing edge 66 relative to the second direction of rotation. The two or more lower blades 60 may each define a distal end 67 and a safety arc 68 which may extend between the proximal end 62 and the distal end 67. In one example, the leading edges 46 of the upper blades 42 are oriented opposite the leading edges 64 of the lower blades 60. The distal ends 67 of the lower blades 60 move between at least the lowered position and the raised position. A vertical membrane, such as a wing member 70, may be secured and substantially parallel to the upper body section 18. The wing member 70 may be sized to provide air resistance when the upper propeller mount 36 and the lower propeller mount 54 are rotating.

The flying toy doll 10 may include a pair of flybar mounting brackets 80 secured to the upper propeller mount 36. Each of the flybar mounting brackets 80 may define a pair of prongs adapted to receive a flybar pin 81 extending therebetween. A flybar 84 may include first and second portions, each portion may define a proximal end adapted to mount to one of the flybar pins 81 to facilitate pivotal movement of the flybar 84 portions between at least a flybar raised position or flybar flying position and a flybar lowered position or flybar resting position. The portions of the flybar 84 may define a distal end which may be weighted to provide stability during rotation of the upper propeller mount 36.

In another example, FIGS. 13A through 18 show a flying and/or hovering toy figure 100 supported by a charge base 104. The toy figure 100 is removable from the charge base 14. The charge base 104 may include a charge base power supply (not shown) and a connector (not shown) to transfer power to the toy figure 100. It is contemplated the toy figure 100 may have other forms such as dolls, figures, characters, and animals. The toy figure 100 may include an upper section 106, a pair of arms 108 extending from the upper section 106, a head 110, and a vertical membrane, such as a wing member 111, secured to the upper section 106. A central shaft 114 may extend from the upper section 106 and define a central axis 115. A lower section 116 may be secured to the central shaft 114. A mid-section 118 may be mounted to the central shaft 114 for rotation about the central axis 115. A leg member 120 may extend from the lower section 116. Two or more propeller assemblies 121 may be mounted to the toy figure 100.

For example, a first propeller mount 122 may be mounted to the central shaft 114 for rotation in a first direction about the central axis 115. The first propeller mount 122 may also be mounted to the central shaft 114 for pivotal movement about at least one axis such as a first propeller mount axis defined by a set of upper receiving brackets 126. The first propeller mount 122 may define the two upper receiving brackets 126. A first set of blades 128 may be mounted to the first propeller mount 122 for pivotal movement between at least two positions. For example, each of the blades of the first set of blades 128 may define a first proximal end 130 and a first distal end 132. Each first proximal end 130 may be mounted to the respective upper receiving bracket 126. A safety arc 134 may extend from the first proximal end 130 to the first distal end 132. The safety arc 134 may assist in preventing contact with a leading edge 135, relative to rotation in the first direction, of the blades 128.

Another example of the two or more propeller assemblies 121 may include a second propeller mount 140 which may be mounted to the central shaft 114 for rotation in a second direction about the central axis 115. The second propeller mount 140 may define two or more lower receiving brackets 142. A second set of blades 144 may be mounted to the second propeller mount 140 for pivotal movement between at least two positions. For example, each of the blades of the second set of blades 144 may define a second proximal end 146 and a second distal end 148. Each second proximal end 146 may be mounted to a respective lower receiving bracket 142. A safety arc 150 may extend between the second proximal end 146 and the second distal end 148. The safety arc 150 may assist in preventing contact with a leading edge 147, relative to rotation in the second direction, of the blades 144.

A gear train 160 may mechanically link the first propeller mount 122 and the second propeller mount 140 for counter rotation. For example, the gear train 160 may link rotation such that the first propeller mount 122 and the second propeller mount 140 always rotate in opposite directions. This counter rotation may assist in providing stability of the toy figure 100 during flight. In one example of the gear train 160. Rotation of the first propeller mount 122 and the second propeller mount 140 may cause the first set of blades 128 and the second set of blades 144 to move between a lowered position and raised position and as such, generate lift.

A flybar mount 170 may be mounted to the central shaft 114 for rotation in the first direction and pivotal movement. A flybar 176 may include first and second portions extending outward from the flybar mount 170. Distal ends of the first and second portions of the flybar 176 may be weighted to assist in providing stability during flight of the toy figure 100. One or more mechanical linkages 182 may link pivotal movement of the first propeller mount 122 and the flybar mount 170. A housing 190 may be secured to the mid-section 118 to contain components therein and to prevent access to the components.

Figure 16:
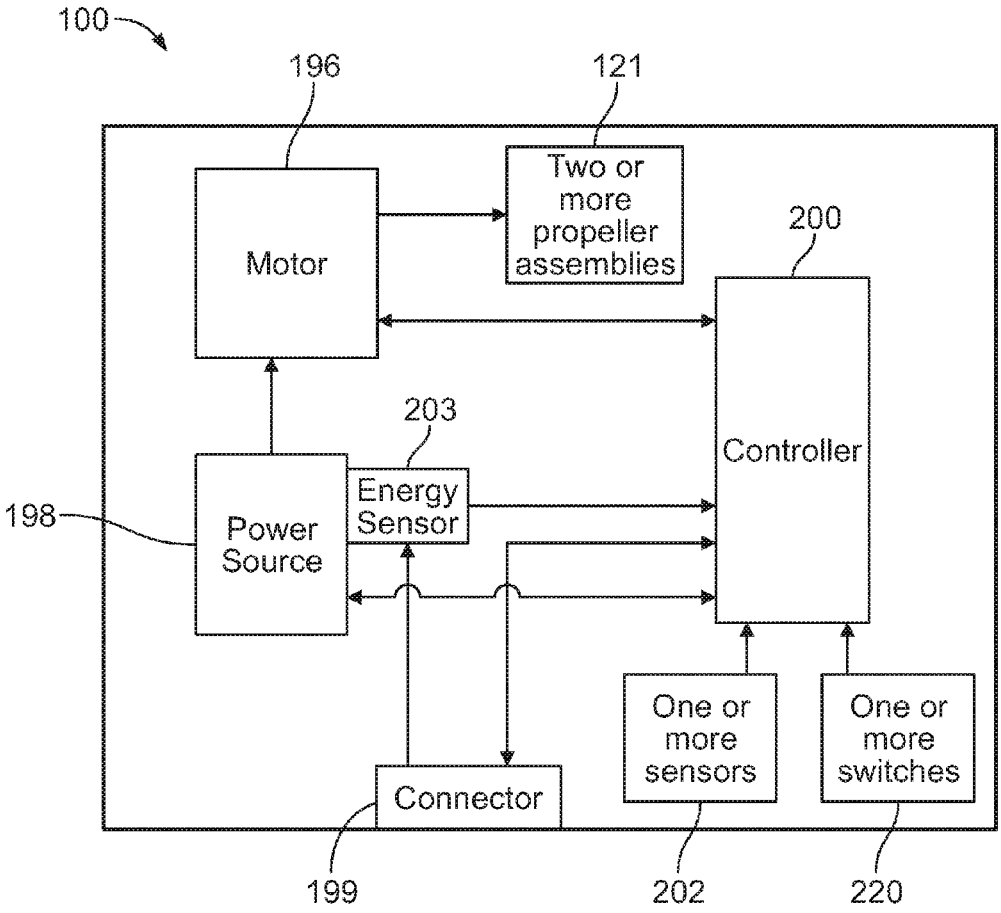
FIG. 16 is a block diagram showing examples of components of the flying toy figure of FIG. 13A.
Figure 17:
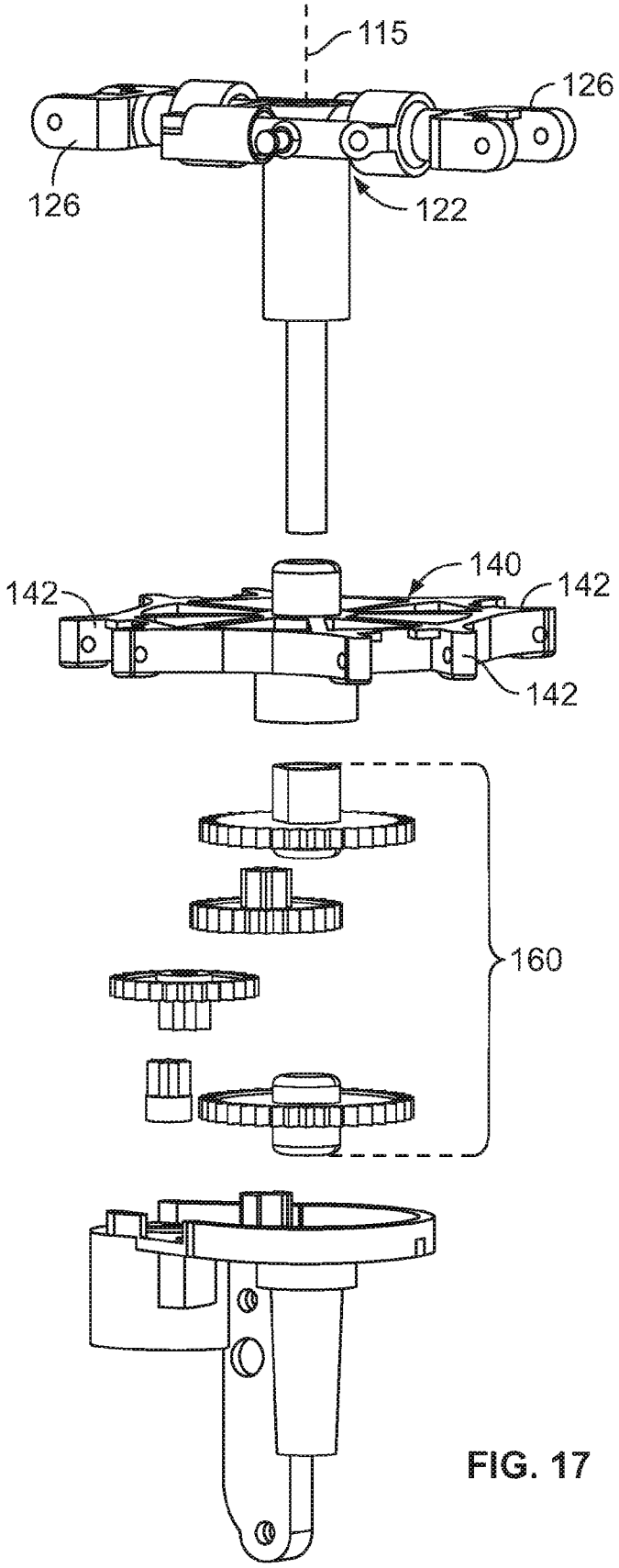
FIG. 17 is an exploded view of an example of a gear train for utilization with the flying toy figure of FIG. 13A.
Figure 18:
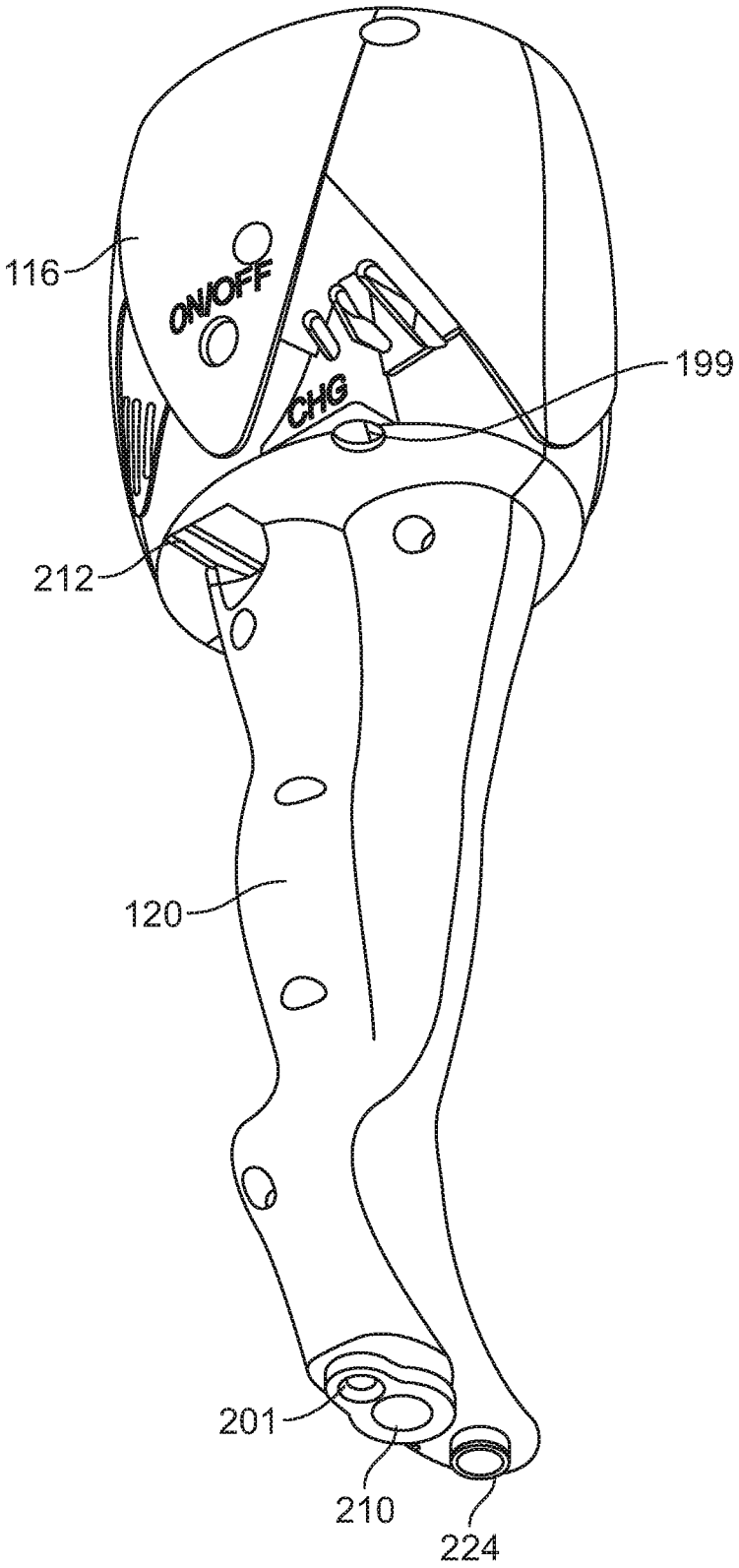
FIG. 18 is a fragmented rear perspective view of the flying toy figure of FIG. 13A showing a portion of a control system.

As shown in FIG. 16, a motor 196 may be in communication with the gear train 160. A power source 198 may be in communication with the motor 196. The power source 198 may be a rechargeable power supply such as a battery or capacitor. The motor 196 and the power source 198 may be secured to the toy figure 100 within, for example, the lower section 116. A connector 199 (shown in FIG. 18) may be secured within the mid-section 106 or other location on the toy figure 100 and may be in communication with the power source 198. The connector 199 may be adapted to mate with the charge base connector to transfer power received from the charge base power supply included within the charge base 14.

A controller 200 may be in communication with the motor 196, the power source 198, and the connector 199. The connector 199 may be further adapted to transfer data, such as software updates or other similar information, to the controller 200 from an external source. An energy sensor 203 may be in communication with the power source 198 and the controller 200 to provide energy level information to the controller 200. The controller 200 may utilize the energy level information from the energy sensor 203 to assist managing charge inputs to and outputs of the power source 198. The leg member 120 may define a well 201 to receive a pin (not shown) on the charge base 14 to support the toy figure 100 in a substantially upright position.

Figure 13A:
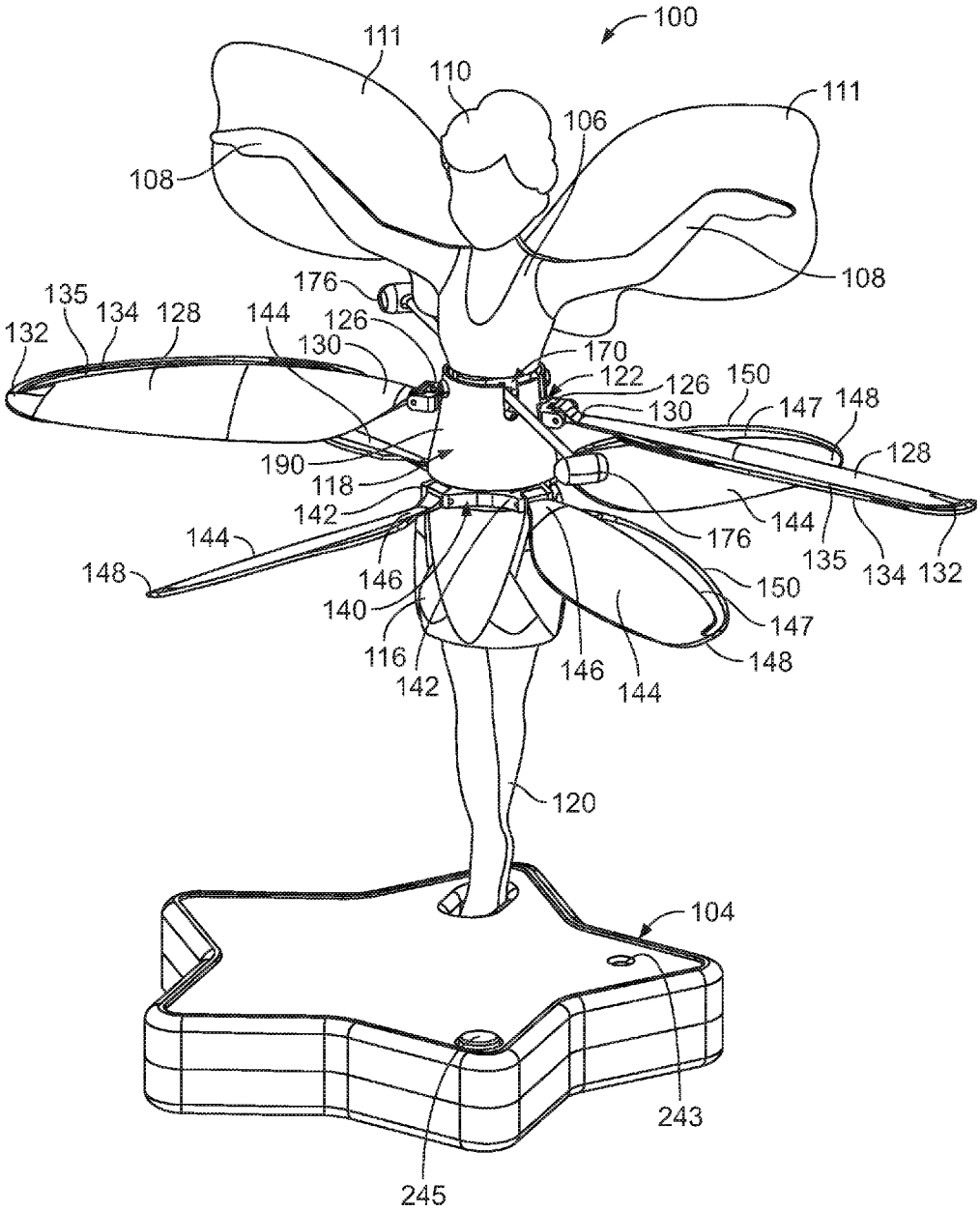
FIG. 13A is a perspective view of an example of a flying toy figure shown in a first configuration and supported by a charge base.
Figure 13B:
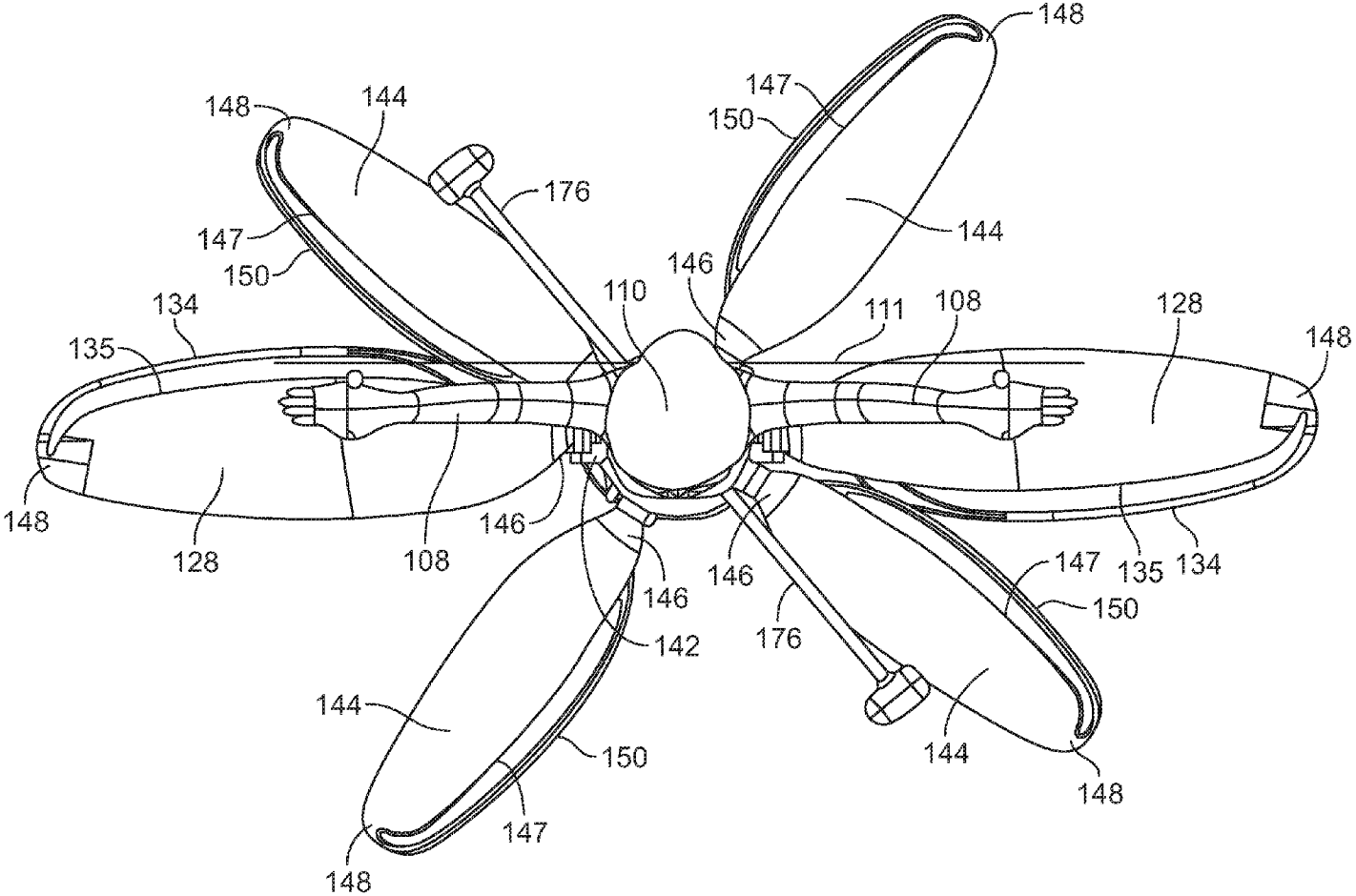
FIG. 13B is a plan view of the flying toy figure from of 13A.
Figure 14A:
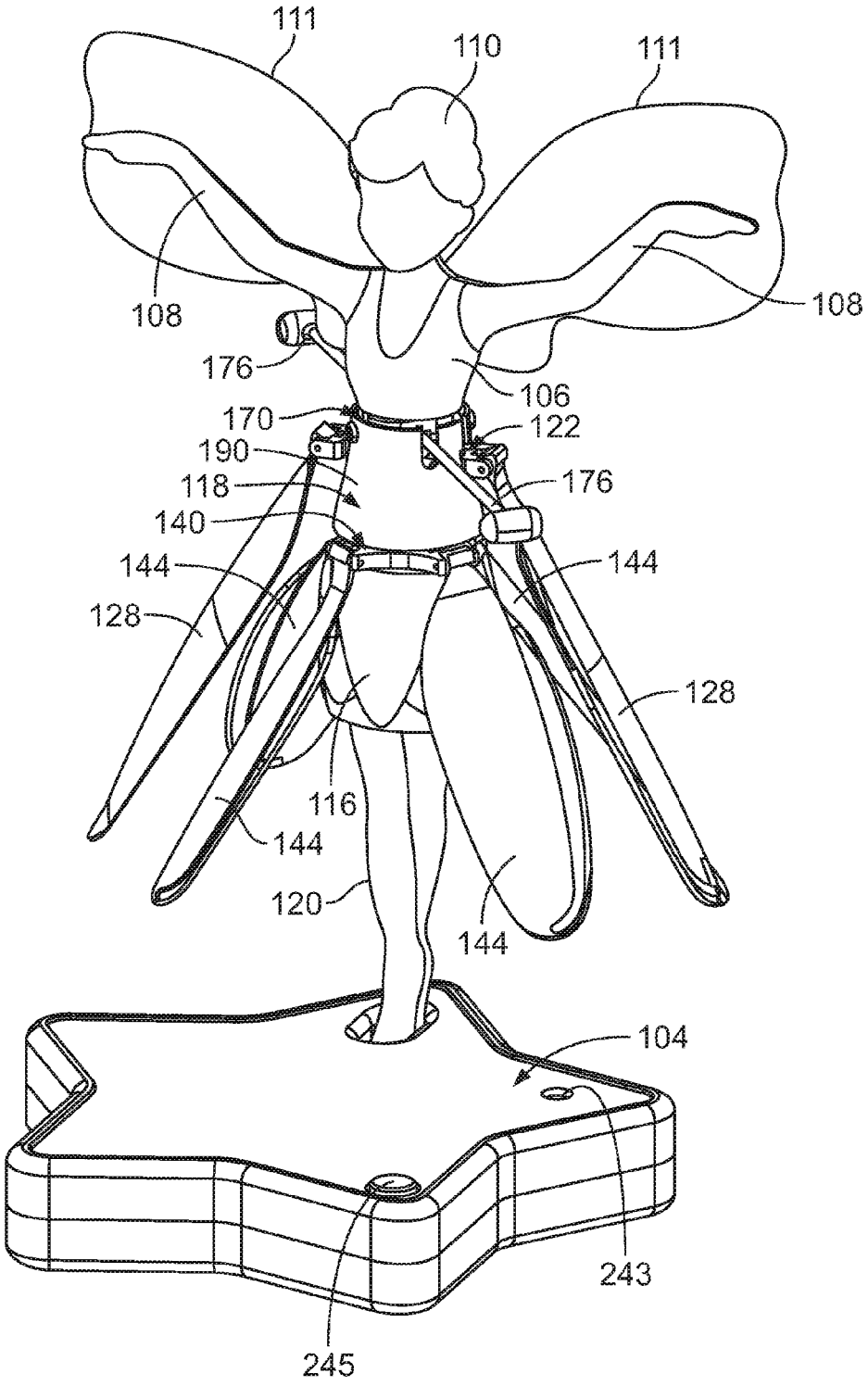
FIG. 14A is a perspective view of the flying toy figure of FIG. 13A shown in a second configuration.
Figure 14B:
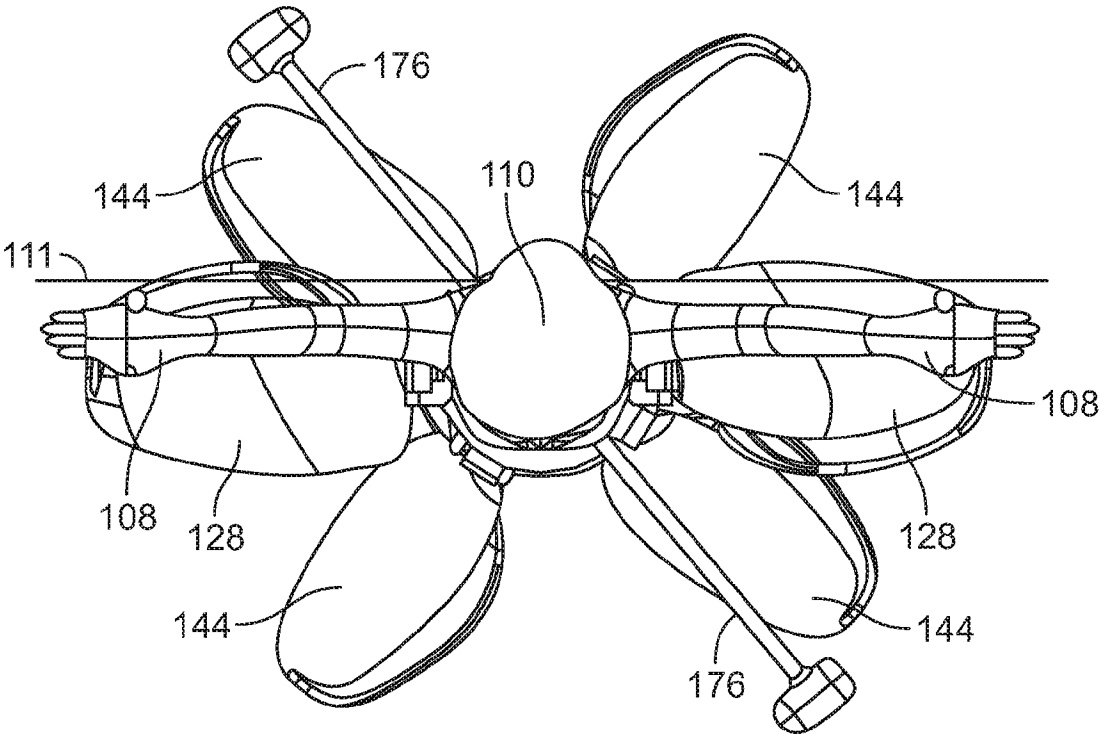
FIG. 14B is a plan view of the flying toy figure of FIG. 14A.
Figure 15:
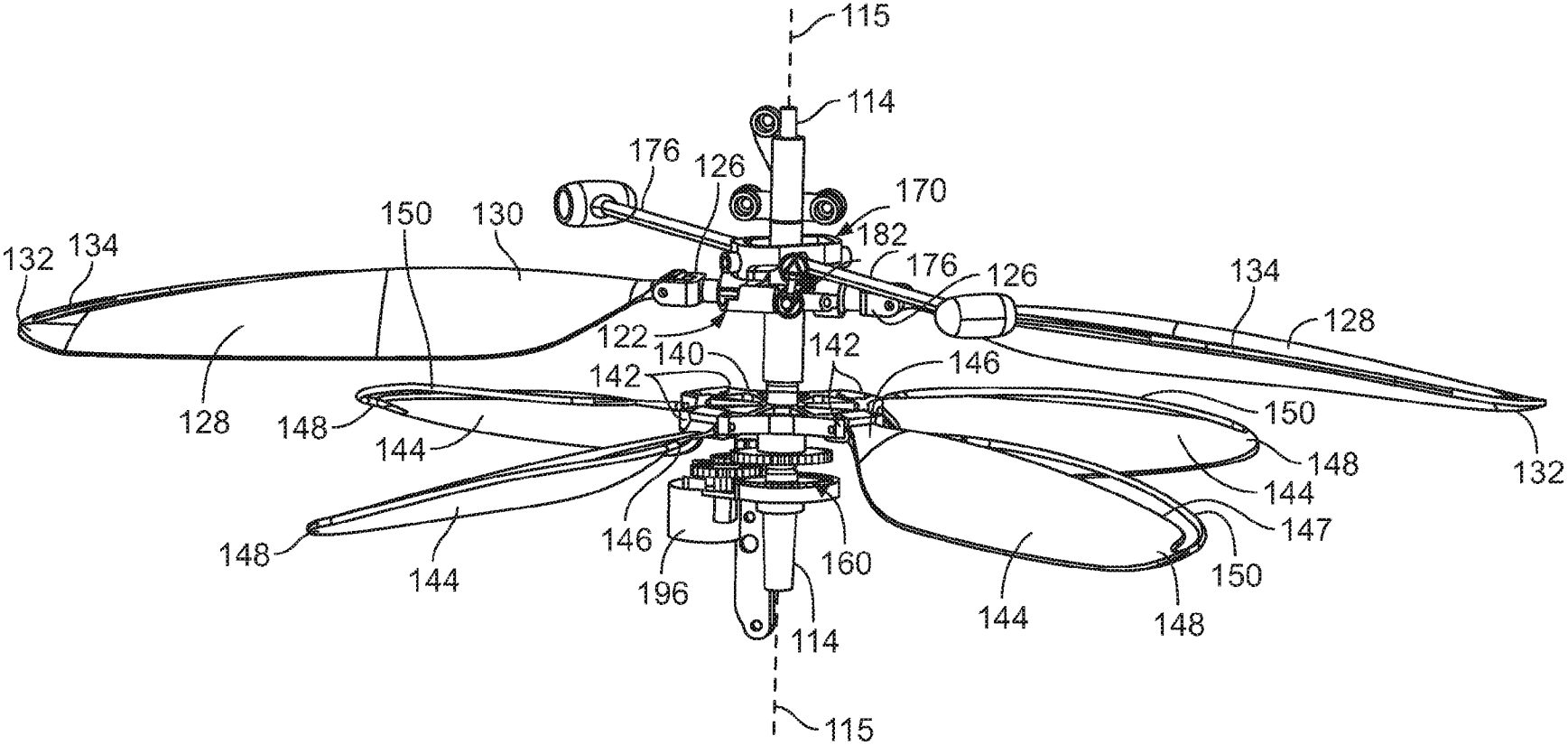
FIG. 15 is a perspective view of an example of a counter rotating propeller assembly.

One or more sensors 202 may be secured to the toy figure 100 and may be in communication with the controller 200. The one or more sensors 202 may include a transmitter and receiver pair which may operate with the controller 200 to assist in detecting obstacles and/or surfaces. For example and as shown in FIG. 13, the one or more sensors 202 may include a lower infrared (IR) transmitter 210 and a lower IR receiver 212. The lower IR transmitter 210, such as a light emitting diode, may be secured to a lower portion of the leg member 120. The lower IR receiver 212 may be secured to the lower section 116 or other location on the toy figure 100. The lower IR transmitter 210 may be oriented to transmit a detection signal away from the toy figure 100 and toward an obstacle and/or surface such that the detection signal may bounce off the same. The lower IR receiver 212 may be oriented to receive the detection signal when reflected off of the obstacle and/or surface under certain conditions. For example, the lower IR receiver 212 may receive the reflected detection signal when the lower IR transmitter 210 is within a predetermined range of distances from the obstacle and/or surface.

The controller 200 may be configured to adjust a speed of the motor 196 in response to the lower IR receiver 212 receiving the reflected detection signal. The controller 200 may be further configured to adjust a speed of the motor 196 in response to the lower IR receiver 212 not receiving the reflected detection signal. The controller 200 may be further configured to adjust the speed of the motor 196 or to deactivate the motor 196 in response to receiving a motor voltage feedback signal indicating rotation obstruction of one or more of the propeller mounts. For example, in a crash scenario of the toy figure 100, an obstacle may prevent rotation of one of the propeller mounts which may result in motor voltage feedback identifiable by the controller 200. As such, the controller 200 may deactivate the motor 196 to prevent burnout of the motor 196 and also to as a safety precaution for users. In another example, the toy figure 100 may hover above the obstacle and/or surface as the controller 200 adjusts the speed of the motor 196 as multiple reflected detection signals are received.

One or more switches 220 may be secured to the toy figure 100 and may be in communication with the controller 200. The one or more switches 220 may include a mechanical switch which may operate with the controller 200 to assist in detecting obstacles and/or surfaces. For example, a switch 224 may be secured to a lower portion of the leg member 120. The controller 200 may be further configured to adjust a speed of the motor 196 in response to receipt of a signal from the switch 224 indicating contact with a surface. The controller 200 may be further configured to initiate a preprogrammed output of the motor 196 in response to receipt of a signal from the switch 224 indicating contact with a surface. For example, the preprogrammed output may be similar to a set of ballerina movements in which the toy figure 100 flies and/or hovers in a sequence when the switch 224 is triggered. Other examples of preprogrammed output of the motor 196 may be based on a predetermined duration of time and/or other play patterns which may be triggered by certain events, such as triggering of the switch 224 or receipt of a detection signal.

Figure 19:
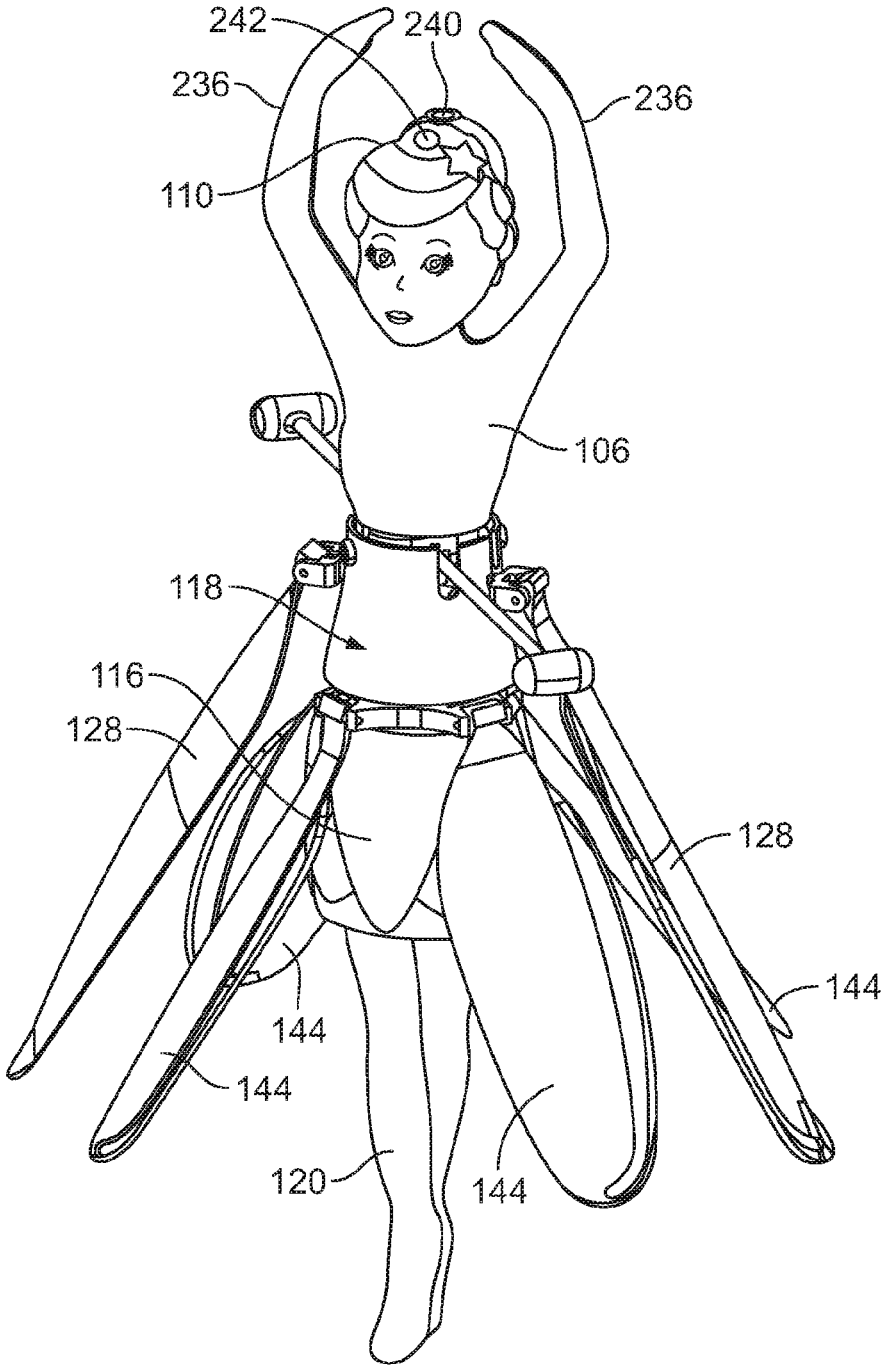
FIG. 19 is perspective view of the flying toy figure of FIG. 13A shown with an example of another upper section embodiment and a pair of arms embodiment.
Figure 20:
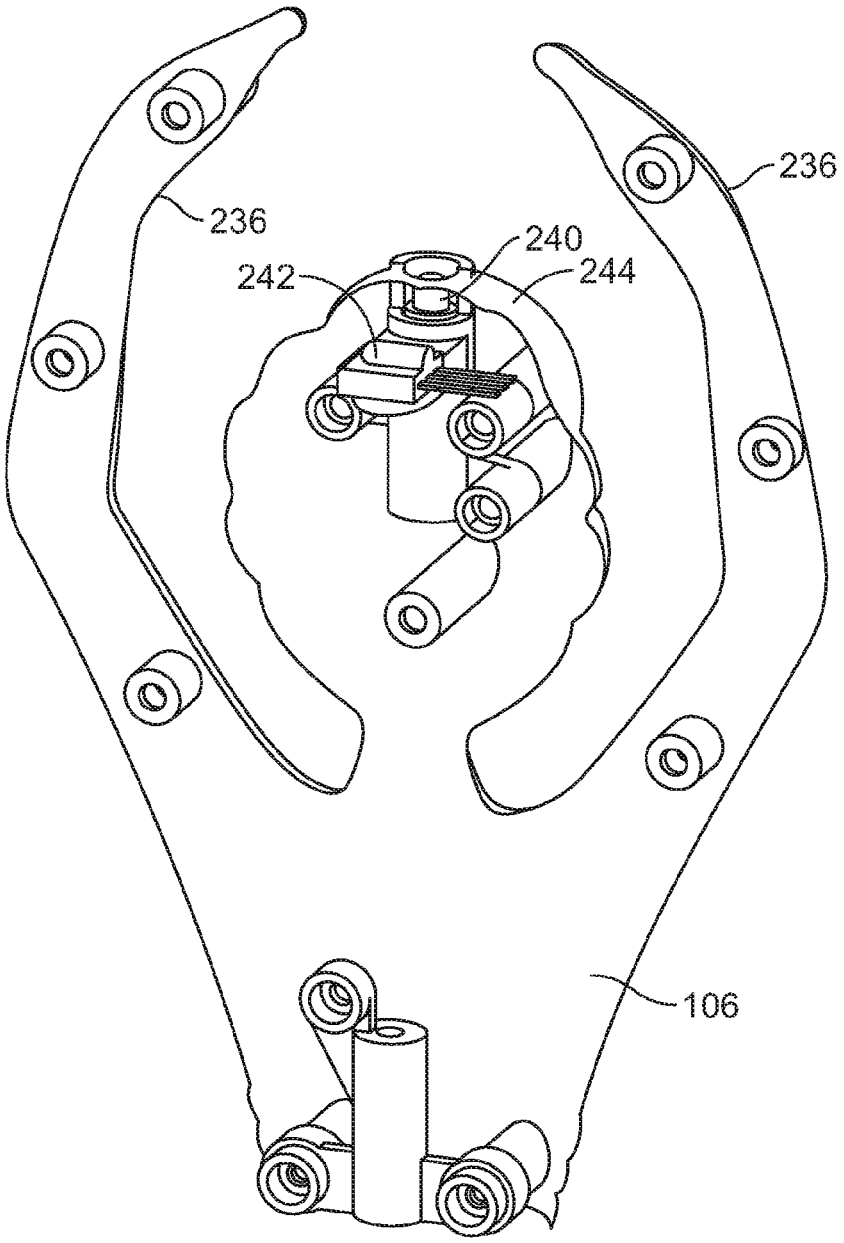
FIG. 20 is a perspective view of the upper section and pair of arms embodiment from FIG. 19 with a portion of the upper section removed to show internal components.

The toy figure 100 may have alternative forms. FIGS. 19 and 20 show another example of the toy figure 100. In this example, a pair of arms 236 extend upward from the upper section 106 in a fashion similar to a ballerina pose. The one or more sensors 202 may include another transmitter and receiver pair to operate with the controller 200 to assist in detecting obstacles and/or surfaces. For example, the one or more sensors 202 may include an upper IR transmitter 240 and an upper IR receiver 242. The upper IR transmitter 240, such as a light emitting diode, may be secured to a head 244. The upper IR receiver 242 may be secured to the head 244. The upper IR transmitter 240 may be oriented to transmit an upper detection signal away from the toy figure 100, upward relative to the head 244, and toward an obstacle and/or surface such that the upward detection signal may reflect off the same. The upper IR receiver 242 may be oriented to receive the upper detection signal when reflected off of the obstacle and/or surface under certain conditions. For example, the upper IR receiver 242 may receive the reflected upper detection signal when the upper IR transmitter 240 is within a predetermined range of distances from the obstacle and/or surface. The controller 200 may be further configured to adjust a speed of the motor 196 in response to the upper IR receiver 242 receiving the reflected upper detection signal. One example of an obstacle includes a user's hand. In this example, the user may place their hand above the toy figure 100 such that the upper detection signal reflects off of the user's hand and the user may thus, control flight and hovering movements of the doll. The controller 200 may be further configured to adjust a speed of the motor 196 in response to the upper IR receiver 242 not receiving the reflected upper detection signal. The controller 200 may be further configured to adjust a speed of the motor 196 in response to various combinations of signals received from lower IR receiver 212, the upper IR receiver 242, and the switch 224 such that the toy figure 100 executes movement sequences which may include dancing and twirling on and above a surface.

The lower IR receiver 212 may be configured to receive motor operation commands in the form of signals from a charge base transmitter 243 of the external charge base 104. The motor operation commands may be triggered by pressing an operation button 245 on the external charge base 104. The motor operation commands may be a preprogrammed launch sequence or a land sequence. The motor operation commands may direct the toy figure 100 to execute one or more dancing, flying, and/or hovering movements in a preprogrammed sequence. The lower IR receiver 212.

Figure 21:
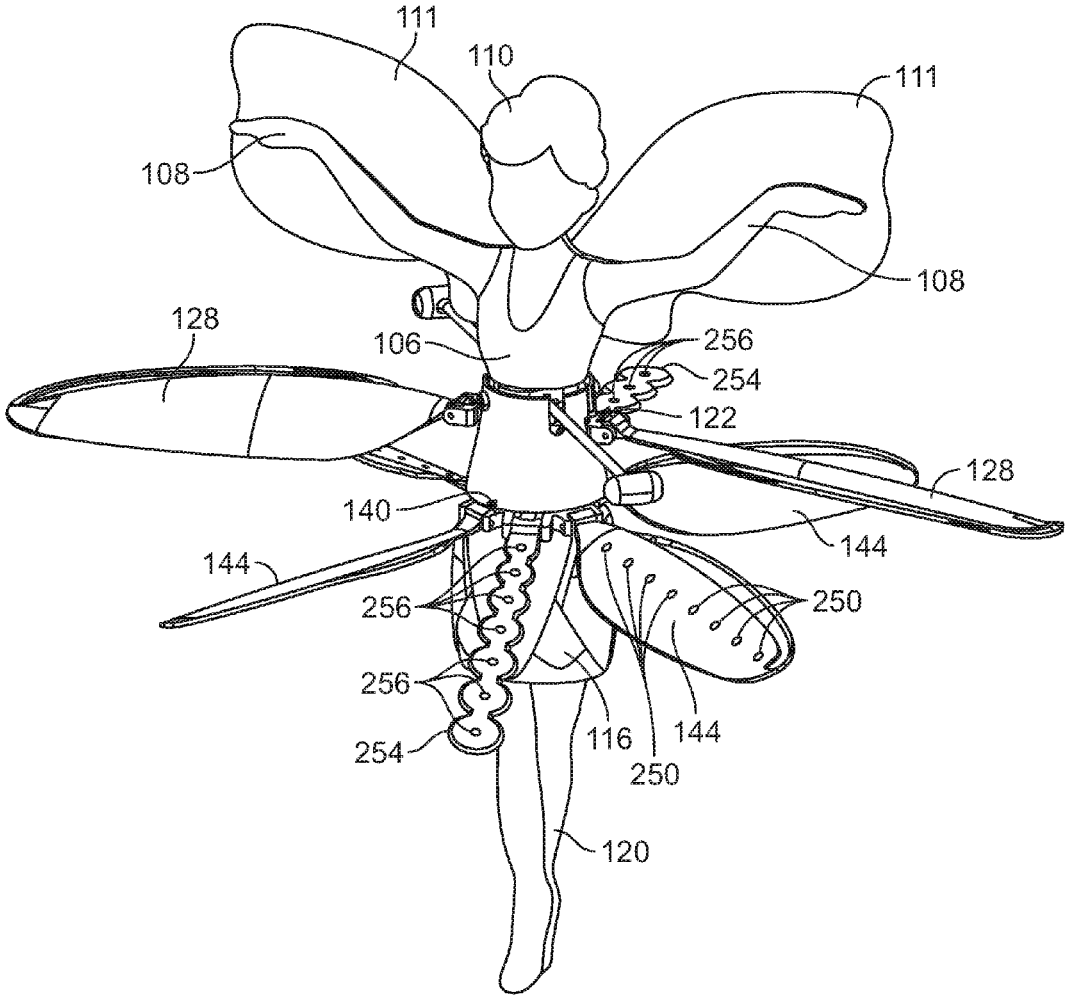
FIG. 21 is a perspective view of the flying toy figure from FIG. 13A shown with examples of lighting features.

In FIG. 21, the toy figure 100 is shown with light features. For example, one or more of the blades 144 may include lights 250, such as LEDs, to provide light effects. While the lights 250 are shown on two of the blades 144, it is contemplated that the lights 250 may be secured to other blades of the toy figure 100. In another example, one or more light extensions 254 may extend outward from the toy figure 100 and include lights 256, such as LEDs, to provide light effects. The light extensions 254 may mounted to, for example, the lower propeller mount 140 for pivotal movement between raised and lowered positions and to rotate with the lower propeller mount 140. When the blades 144 and/or light extensions 254 are rotating, the lights 250 and lights 256 may be directed to illuminate by the controller 200 in various patterns and sequences.

While various embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A flying toy doll comprising:

a doll body extending in a longitudinal direction and having a longitudinal axis being substantially vertical, the doll having a mid-body section defined longitudinally between an upper body section and a lower body section;

a doll head secured to the upper body section;

a pair of arms secured to the upper body section and each extending outwardly therefrom;

an upper propeller assembly mounted to the doll body and having at least two upper blades hinged at a proximal end of the upper blade for pivotal movement such that a distal blade end moves between at least a resting position and a flying position, wherein in the flying position, the upper blades are generally perpendicular to the longitudinal axis of the doll body, each of the upper blades having a leading edge and a trailing edge extending between the distal end and proximal end of the upper blades, wherein the leading edge includes a safety are portion; and a lower propeller assembly mounted to the doll body and offset a longitudinal distance below the upper propeller assembly and having two or more lower blades hinged at a proximal end of each of the lower blades for pivotal movement such that a distal blade end of each of the blades moves between at least a resting position and a flying position, wherein in the flying position, the lower blades are mounted to rotate substantially in a plane generally perpendicular to the longitudinal axis of the doll body, each of the lower blades having a leading edge and a trailing edge extending between the distal end and proximal end of the lower blades, wherein a safety arc portion extends between the proximal end and the distal end adjacent to the leading edge, wherein the upper leading edges of the upper blades are oriented opposite the lower leading edges of the lower blades, wherein the two upper blades and the two or more lower blades form an appearance of a skirt and conceal at least a portion of the lower body section of the doll when in the resting positions.

2. The flying toy doll of claim 1, further comprising a vertical membrane secured to the upper body being substantially parallel to the doll body and extending outward to provide air resistance.

3. The flying toy doll of claim 2, wherein the vertical membrane is a wing member.

4. The flying toy doll of claim 3, wherein the upper propeller assembly further comprises:

a pair of flybar mounting brackets each having a pair of bar prongs adapted to receive a flybar pin extending therebetween; and a flybar comprising a first bar and a second bar, each defining a bar proximal end adapted to mount to one of the flybar pins for pivotal movement between at least a flybar lowered position and a flybar raised position, and each defining a bar distal end weighted to assist in providing stability during flight.

5. The flying doll of claim 4, wherein the upper propeller assembly includes upper receiving brackets for mounting the proximal end of each of the upper blades, each of the upper receiving brackets including a pair of upper bracket prongs adapted to receive an upper pin extending therebetween, and wherein an extension from the proximal ends of the two upper blades is mounted to the respective upper pin.

6. The flying doll of claim 5, wherein the lower propeller assembly includes lower receiving brackets for mounting the proximal end of each of the lower blades, each of the lower receiving brackets including a pair of lower bracket prongs each adapted to receive a lower pin extending therebetween, and wherein an extension from the proximal ends of the lower blades is mounted to the respective lower pin.

7. A flying toy figure comprising:

a doll body extending in a longitudinal direction and having a longitudinal axis being substantially vertical;

a first propeller assembly mounted to rotate in a first direction about the longitudinal axis of the doll body and positioned longitudinally along a mid-portion of the doll body;

a second propeller assembly mounted to rotate in a second direction about the longitudinal axis of the doll body and positioned below the first propeller assembly, wherein the second propeller assembly is mechanically linked to the first propeller assembly for counter rotation in the second direction when the first assembly rotates in the first direction;

a motor in communication with the first and second propeller assemblies to drive the first and second propeller assemblies in the first and second direction at a speed;

a rechargeable power source in communication with the motor, a switch secured to a foot portion of the body to detect a surface external to the doll body and configured to provide a surface detection signal; and a controller in communication with the motor and switch and configured to adjust a speed of the motor in response to receiving the surface detection signal, wherein adjusting the motor speed adjusts a counter-rotational speed of the first and second propeller assemblies.

8. The flying toy figure of claim 7, wherein the controller is further configured to initiate a preprogrammed sequence of motor outputs in response to receiving a signal from the switch indicating contact with a surface.

9. The flying toy figure of claim 7, wherein the first propeller assembly includes two upper blades and the second propeller assembly includes two lower blades.

10. The flying toy figure of claim 7, further comprising:

an upper transmitter secured to a head of the body, oriented to send an upper detection signal in an upward direction relative to the head, and in communication with the controller; and an upper receiver secured to the head, oriented to receive a reflected upper detection signal, and in communication with the controller, wherein the controller is further configured to adjust a speed of the motor in response to the upper receiver receiving the reflected upper detection signal indicating detection of an upper surface above the head.

11. The flying toy figure of claim 10, further comprising:

a lower transmitter secured to the foot portion of the body to transmit a lower detection signal in a downward direction relative to the foot portion, and in communication with the controller; and a lower receiver secured to a lower section of the body to receive a reflected lower detection signal, and in communication with the controller, wherein the controller is further configured to adjust a speed of the motor in response to the lower receiver receiving the lower detection signal indicating detection of a lower surface below the foot portion.

12. The flying toy figure of claim 7, further comprising:

a flybar mount mounted to the mid-portion of the body for rotation in the first direction and pivotal movement;

a flybar including two portions, each extending outwardly from the flybar mount along a flybar axis; and a mechanical linkage linking the first propeller assembly and the flybar mount for synchronized pivotal movement.

13. The flying toy figure of claim 7, further comprising one or more lights on at least one blade of one of the propeller assemblies.

14. The flying figure of claim 7, further comprising a connector to receive and transfer power from an external power source to the rechargeable power source.

15. The flying toy figure of claim 7, further comprising a connector adapted to receive and transfer programming data to the controller from an external source.

16. The flying toy figure of claim 7, wherein one of the first propeller assembly or the second propeller assembly further comprises a light extension extending outward and including one or more lights.

17. A flying toy doll comprising:

an upper section;

a pair of arms fixed to the upper section;

a head fixed to the upper section;

a central shaft extending from the upper section and defining a central axis extending in an upright direction;

a lower section fixed to the central shaft;

a mid-section disposed between the lower section and the upper section and mounted to the central shaft for rotation about the central axis;

a leg member fixed to the lower section;

a first propeller mount mounted to the central shaft for rotation in a first direction about the central axis and pivotal movement about a first propeller mount axis defined by two upper receiving brackets extending outward;

a first set of blades, wherein each blade is connected to the first propeller mount to pivot at a first proximal end mounted to one of the upper receiving brackets for hinged movement at the first proximal end between at least a lowered and raised position, and a safety arc extending from the proximal end to a distal end;

a second propeller mount mounted to the central shaft below the mid-section for rotation in a second direction and defining at least two lower receiving brackets extending outward;

a second set of blades each defining a second proximal end mounted to one of the lower receiving brackets for hinged movement at the second proximal end between at least a lowered and raised position;

a gear train mechanically linking the first and second propeller mounts for counter rotation such that the second propeller mount rotates in the second direction when the first propeller mount rotates in the first direction;

a motor in communication with the gear train;

a rechargeable power source in communication with the motor, a lower transmitter secured to the leg member to transmit a lower detection signal;

a lower receiver secured to the lower section to receive a reflected lower detection signal indicative of a surface being external to the toy doll at a distance; and a controller in communication with the motor, the lower transmitter, and the lower receiver, and configured to adjust a speed of the motor in response to the lower receiver receiving the reflected lower detection signal, wherein adjusting the motor speed adjusts a counter-rotational speed of the first and second propeller mounts.

18. The flying toy doll of claim 17, further comprising a vertical membrane fixed to the upper section and defining a cross-sectional area to provide air resistance during flight of the flying toy doll.

19. The flying toy doll of claim 17, wherein the controller is further configured to adjust a speed of the motor in response to the lower receiver not receiving the reflected lower detection signal.

20. The flying toy doll of claim 17, wherein the controller is further configured to deactivate the motor in response to the controller receiving a motor voltage feedback signal indicating rotational obstruction of the first or second propeller mounts.

21. The flying toy doll of claim 17, further comprising a switch in communication with the controller and secured to a lower portion of the leg member to contact a surface, and wherein the controller is further configured to adjust a speed of the motor in response to the switch contacting a surface.

22. The flying toy doll of claim 17, further comprising a connector in communication with the rechargeable power source and adapted to transfer power received from an external power source to the rechargeable power source.

23. The flying toy doll of claim 22, wherein the connector is further adapted to receive and transfer programming data to the controller from an external source.

24. The flying toy doll of claim 22, wherein the lower receiver is configured to receive motor operation commands from a charge base transmitter of an external charge base.

25. The flying toy doll of claim 24, wherein the motor operation commands are a launch sequence or a land sequence.

26. The flying toy doll of claim 24, wherein the motor operation commands are a preprogrammed set of motor output commands.

27. The flying toy doll of claim 17, wherein the leg member defines a receiving well to receive a pin from an external charge base to support the doll in a substantially upright position.

28. The flying toy doll of claim 17, further comprising:

a flybar mount mounted to the central shaft for ration in the first direction and pivotal movement;

a flybar extending outwardly from the flybar mount along a flybar axis; and a mechanical linkage to link pivotal movement of the first propeller mount and the flybar mount.

29. The flying toy doll of claim 17, further comprising one or more lights on at least one of the blades.

30. The flying toy doll of claim 17, further comprising one or more light extensions secured to one of the propeller mounts and including one or more lights.

31. A flying toy figure comprising:

an upper section;

a pair of arms extending upward from the upper section;

a head fixed to the upper section;

a central shaft extending from the upper section and defining a central axis extending in an upright direction;

a lower section fixed to the central shaft;

a mid-section disposed between the lower section and the upper section and mounted to the central shaft for rotation;

a leg member fixed to the lower section;

a first propeller mount mounted to the central shaft for rotation in a first direction and pivotal movement, and defining two upper receiving brackets;

a first set of blades, wherein each blade of the first set of blades is connected to the upper receiving brackets to pivot between at least two positions;

a second propeller mount mounted to the mid-section for rotation in a second direction and defining four lower receiving brackets extending outward;

a second set of blades, wherein each blade of the second set of blades is connected to one of the lower receiving brackets to pivot between at least two positions;

a flybar mount mounted to the central shaft for rotation in the first direction and pivotal movement;

a flybar mounted to the flybar mount;

a gear train mechanically linking the first and second propeller mounts for counter rotation;

a motor secured to the lower section and in communication with the gear train;

a rechargeable power source in communication with the motor;

a controller configured to direct operation of the motor and rechargeable power source;

an upper transmitter secured to the head, oriented to send an upper detection signal in an upward direction relative to the head, and in communication with the controller; and an upper receiver secured to the head, oriented to receive the upper detection signal when reflected off of a surface, and in communication with the controller, wherein the controller is further configured to adjust a speed of the motor in response to the upper receiver receiving the reflected upper detection signal indicating detection of a surface.

32. The flying toy figure of claim 31, further comprising a switch in communication with the controller and secured to a lower portion of the leg member to contact a surface, wherein the controller is further configured to adjust a speed of the motor in response to a control signal received from the switch indicating contact with a surface.

33. The flying toy figure of claim 32, wherein the controller is further configured to adjust the speed of the motor according to a predetermined time sequence in response to the switch indicating contact with a surface.

34. The flying toy figure of claim 31, further comprising:

a lower transmitter secured to a lower portion of the leg member, oriented to send a lower detection signal in a downward direction relative to the leg member, and in communication with the controller; and a lower receiver secured to the lower section, oriented to receive the lower detection signal when reflected off of a surface, and in communication with the controller, wherein the controller is further configured to adjust a speed of the motor in response to receiving or not receiving the reflected lower detection signal.

35. The flying toy figure of claim 31, further comprising a connector in communication with the rechargeable power source and adapted to transfer power received from an external charge base to the rechargeable power source.

36. The flying toy figure of claim 31, further comprising one or more lights on at least one of the blades.

37. The flying toy figure of claim 31, further comprising one or more light extensions secured to one of the propeller mounts and including one or more lights.

38. The flying toy figure of claim 31, wherein the pair of arms simulate a ballet pose.

* * * * *